US012220013B1

(12) United States Patent
Graham et al.

(10) Patent No.: US 12,220,013 B1
(45) Date of Patent: Feb. 11, 2025

(54) SIZE ADJUSTMENT SYSTEM FOR CLOTHING AND HATS

(71) Applicants: Joey Graham, Nashville, TN (US); Colin Cochran, Dayton, OH (US); James Protich, Nashville, TN (US)

(72) Inventors: Joey Graham, Nashville, TN (US); Colin Cochran, Dayton, OH (US); James Protich, Nashville, TN (US)

( * ) Notice: Subject to any disclaimer, the term of this patent is extended or adjusted under 35 U.S.C. 154(b) by 24 days.

(21) Appl. No.: 18/097,686

(22) Filed: Jan. 17, 2023

Related U.S. Application Data

(60) Provisional application No. 63/300,423, filed on Jan. 18, 2022.

(51) Int. Cl.
*A42B 1/22* (2006.01)

(52) U.S. Cl.
CPC ..... *A42B 1/22* (2013.01)

(58) Field of Classification Search
CPC .. A42B 1/22; Y10T 24/45246; A44B 11/2592
See application file for complete search history.

(56) References Cited

U.S. PATENT DOCUMENTS

| | | | | |
|---|---|---|---|---|
| 3,900,923 | A * | 8/1975 | Thomas | B65D 63/1072 24/16 PB |
| 6,457,210 | B1 * | 10/2002 | Shirai | A44B 11/2592 24/16 PB |
| 8,146,211 | B2 * | 4/2012 | Shirai | A41F 1/008 24/191 |
| 8,650,665 | B2 * | 2/2014 | Shirai | A41F 1/008 2/183 |
| 2010/0281661 | A1 * | 11/2010 | Harada | A44B 11/06 24/593.11 |
| 2021/0000223 | A1 * | 1/2021 | Redman | A42B 3/08 |

* cited by examiner

*Primary Examiner* — Robert Sandy
(74) *Attorney, Agent, or Firm* — Ralph E. Jocke; WALKER & JOCKE

(57) ABSTRACT

A size adjustment system enables a wearer to adjust the size of an article of clothing such as a hat, to obtain a desired personalized fit. Exemplary arrangements include releasably engageable first and second pieces that are respectively attached to disposed portions of the article of clothing. A first piece includes a manually deformable body including a projection, and a second piece includes a plurality of projections or recesses extending along a surface thereof that are engageable with the projection. In an undeformed condition of the body the projection is engaged with one of the projections or recesses and the first and second pieces are held in fixed relative positions. Manual deformation of the body causes the projection to disengage from the projection or recess, and the first and second pieces are relatively movable until the body is returned to the undeformed condition, and the pieces are again held in fixed positions.

18 Claims, 23 Drawing Sheets

SIZE ADJUSTMENT SYSTEM FOR CLOTHING AND HATS

TECHNICAL FIELD

Exemplary arrangements relate to a size adjustment system for clothing such as hats. More particularly, exemplary arrangements relate to a size adjustment system in operative connection with a hat that is configured to be easily manipulated while positioned on a head of the user to change the size or fit of the hat, thereby enabling the user to adjust the hat to a more personalized fit.

BACKGROUND

Size adjustment systems for clothing items such as hats are useful for temporarily tailoring the size of the clothing item or hat to the user's specific body size or type. A typical size adjustment system includes a set of positions that correspond to different sizes to which the user can adjust their clothing item such as a hat. The set positions typically correspond to notches, holes, or other structures that the size adjustment system is configured to utilize to maintain the clothing item or hat in the user's preferred size. However, in many instances, users are not able to find a set position that provides the user with a personalized and comfortable fit.

Size adjustment systems for clothing and hats may benefit from improvements.

SUMMARY OF THE DISCLOSURE

The exemplary arrangements comprise a size adjustment system that is operative to adjust the size of an article of clothing such as a hat, to a user's desired size, creating a more personalized fit. Exemplary arrangements comprise a first piece and a second piece that are releasably engageable, and which are operatively attached to at least two portions of an article of clothing such as a hat.

The exemplary first piece and second piece are movable to an interlocked condition in which at least one of the first piece and the second piece is movable relative to the other to adjust the size of the article of clothing or hat. More particularly, in exemplary arrangements, the first piece includes a projection in operative connection therewith and the second piece includes a plurality of recesses disposed along a surface thereof in facing relation to with the first piece.

The first piece further includes a deformable body that serves as an engaging mechanism that is operative to move the projection between an engaged position and a disengaged position responsive to manipulation by the user. In the engaged position, the projection extends in one of the plurality of recesses of the second piece such that the first piece and the second piece are interlocked and cannot be moved in a longitudinal direction relative to one another. In the disengaged position, the projection is disposed a sufficient amount from the recesses such that the first piece and the second piece are enabled to be moved through further manipulation by the user in a longitudinal direction relative to one another. As such, the exemplary system is operative to adjust the size of the article of clothing such as a hat to the user's desired size, creating a more personalized fit.

DETAILED DESCRIPTION

Figure 1:
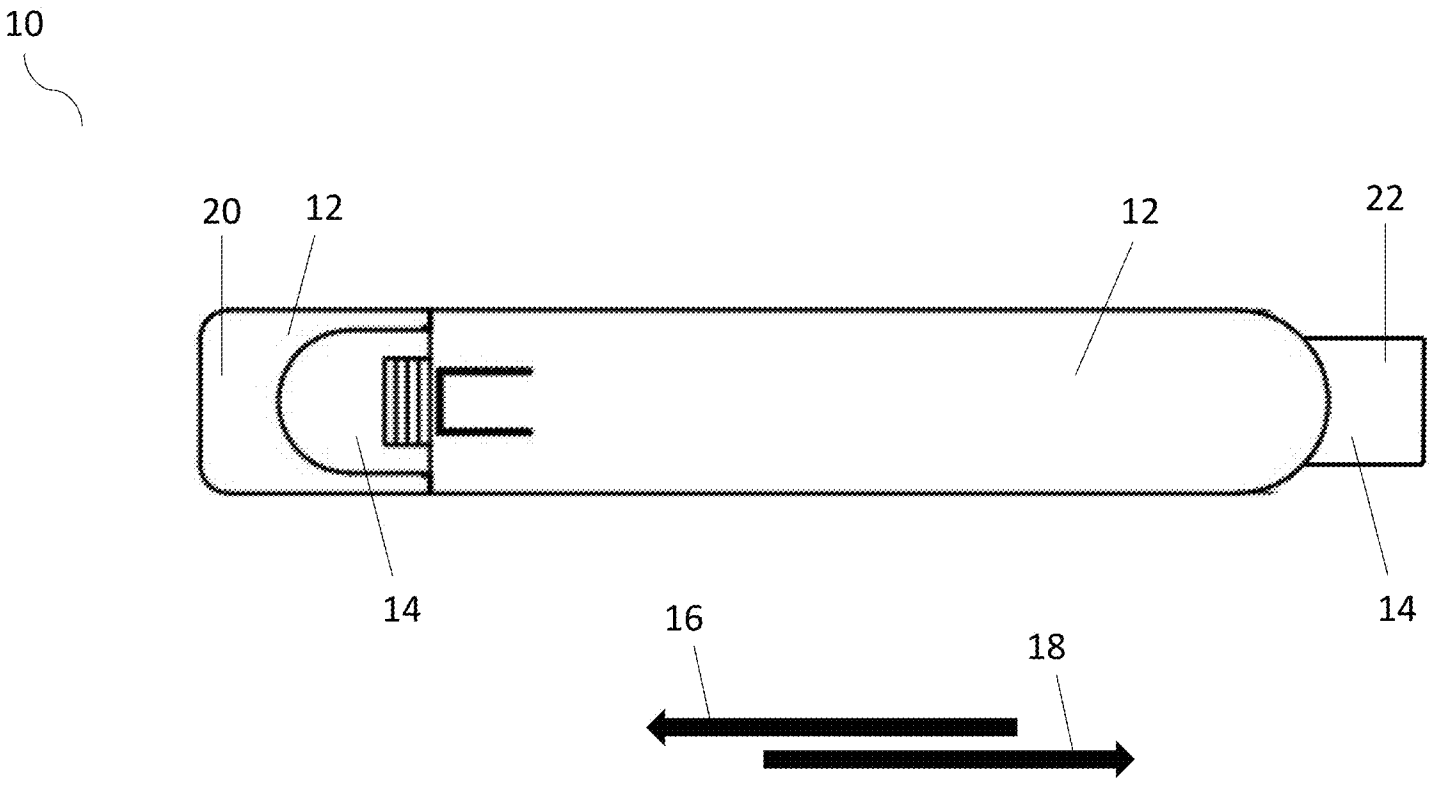
FIG. 1 is a front plan view of an exemplary size adjustment system.

Referring now to the drawings, and particularly to FIG. 1, there is shown therein an exemplary arrangement of a size adjustment system 10. The exemplary system 10 is configured to be operatively connected to a hat or other article of clothing. In alternative exemplary arrangements, the exemplary system 10 is configured to be integrally formed with an article of clothing or hat. Specifically, the exemplary system 10 is configured to be operatively connected to at least two portions of an article of clothing, such as two disposed portions of a hat. The exemplary system 10 is operative to draw the two portions of the clothing article or hat toward each other responsive to manual manipulation of the system 10 by a user. The exemplary system 10 enables a user to adjust the size or fit of the article of clothing or hat by causing greater separation between the two portions of the clothing article or hat, thereby enabling the user to make the size of the article of clothing or hat larger. Conversely, the user may manipulate the exemplary system 10 to cause the two portions of the article of clothing or hat to move closer together, thereby enabling the user to make the size of the article of clothing or hat smaller. As such, the exemplary size adjustment system 10 enables the user to obtain a more personalized size or fit of the clothing article or hat.

Although the exemplary arrangements discussed and shown herein disclose the exemplary size adjustment system 10 in operative connection with a hat, the exemplary arrangements are configured to be useable in a similar manner in operative connection with other articles of clothing. For example, the exemplary system 10 is configured to be permanently or releasably operatively connected, or integrally formed with two portions of a shirt or top, a dress, a waistline portion or torso portion, a bra strap, a dress strap, or any portion of an article of clothing. In arrangements in which the exemplary adjustment system 10 is operatively connected to, or integrally formed with an article of clothing, the system 10 is operative to draw the two portions together creating a smaller or more personalized fit of the clothing article. The exemplary system 10 is also configured to be manipulated such that the smaller more personalized fit can be easily reversed by creating greater separation between the two portions of the article of clothing. In further alternative arrangements, the exemplary system 10 may further include a structure or mechanism for folding the excess material of the article of clothing in an appealing manner so as to preserve a fashionable style of the article of clothing for the user. Of course, the exemplary systems may be used in other ways as well.

Referring now to FIG. 1, there is shown therein an exemplary system 10 configured to be operatively connected to, or integrally formed with a hat. In exemplary arrangements, the exemplary system 10 comprises a first piece or body 12 and a second piece or a flexible strap piece 14. The exemplary first piece 12 and second piece 14 are configured to be interlocked in contacting relation. In exemplary arrangements, the second piece 14 is movable relative to the first piece 12 in a first longitudinal direction indicated at arrow 16 and in an opposing second longitudinal direction indicated at arrow 18. The exemplary first piece 12 includes an attachment portion 20 and the exemplary second piece 14 includes an attachment portion 22. The exemplary attachment portions 20 and 22 are configured to be operatively attachable to, or integrally formed with a fabric or other portion of a hat, best shown in FIG. 2. The exemplary attachment portions 20 and 22 are operatively attachable to portions of an article of clothing or hat through any means of attachment. For example, the exemplary attachment portions may be connected to the hat by sewing, stitching, adhesives, sonic welding, heat welding, clips, fusion, or any method of attachment or connection. As should be understood, this arrangement is merely exemplary, and in other arrangements, other structures and configurations may be used.

Figure 2:
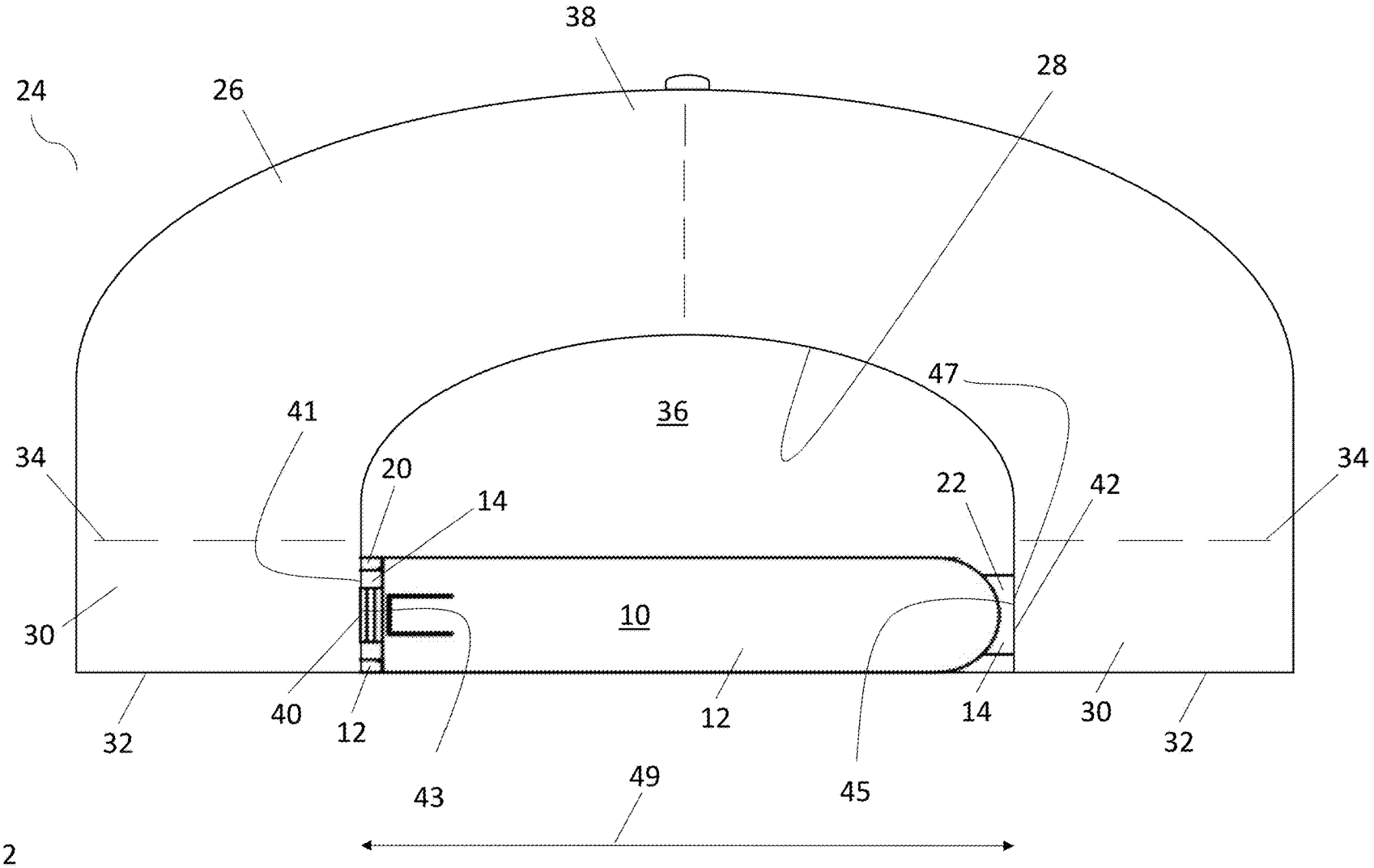
FIG. 2 is a front plan view of an exemplary size adjustment system in operative connection with an exemplary hat.

Now referring to FIG. 2, there is shown therein an exemplary system 10 in operative connection with portions of an exemplary hat 24. The exemplary hat 24 comprises a generally ball-cap type hat. However, the exemplary arrangements may be configured to work with other hat types as well. The exemplary hat 24 includes an outside surface 26 and an opposing inside surface 28. The exemplary hat 24 further includes an internal band 30 (shown in phantom) that extends in surrounding, underlying relation of the inside surface 28. The exemplary band 30 is connected to the hat at a bottom edge 32 of the hat. For example, the band 30 may be connected to the hat at the bottom edge 32 via stitching, sewing, or any method of attachment or connection. The band 30 includes a top edge 34 (shown in phantom) that is attached to the inside surface 28 of the hat at disposed points through any of the attachment means or methods discussed herein.

The exemplary hat 24 further includes a U-shaped opening 36 disposed in a back or rear portion of the hat. The exemplary opening 36 extends from the bottom edge 32 of the hat 24 toward a crown portion 38 of the hat. The exemplary opening includes a first side 40 and an opposed second side 42. The first side 40 includes a vertical slot 43 that extends longitudinally intermediate of the inside surface 28 and the band 30 and includes a slot opening 41 that extends vertically intermediate of the bottom edge 32 and the top edge 34. The second side 42 includes a vertical slot 45, similar to slot 43, that extends longitudinally intermediate of the inside surface 28 and the band 30 and includes a slot opening 47 that extends vertically intermediate of the bottom edge 32 and the top edge 34. However, it should be understood that this arrangement of the hat is merely exemplary, and the exemplary system may be used in operative connection with other hat arrangements.

In exemplary arrangements, the exemplary size adjustment system 10 comprises a length 49 that extends longitudinally and transversely across the U-shaped opening 36 between the first side 40 and the second side 42. The exemplary first piece or body 12 comprises a length that extends longitudinally from the first side 40 of the U-shaped opening 36 toward the second side 42. In exemplary arrangements, the attachment portion 20 of first piece 12 is configured to be operatively attached to, or integrally formed with one of the outside surface 26, the inside surface 28, or the internal band 30 of the hat adjacent the first side 40 of the opening 36. In alternative exemplary arrangements, the attachment portion 20 of piece 12 extends through the slot opening 41 and into slot 43 and is operatively connected to at least one of the inside surface 28 or the band 30 within slot 43 through any of the attachment or connection means or methods discussed herein.

Similarly, the attachment portion 22 of second piece or flexible strap piece 14 comprises a length that extends longitudinally from the second side 42 of the U-shaped opening 36 toward the first side 40. The exemplary attachment portion 22 of second piece 14 is operatively attached to the outside surface 26, the inside surface 28, or the internal band 30 of the hat adjacent the second side 42. In alternative exemplary arrangements, the attachment portion 22 of piece 14 extends through the slot opening 47 into slot 45 and is operatively connected to or integrally formed with one of the inside surface 28 or the band 30 within slot 45, through any of the attachment or connection means or methods discussed herein. Of course, as should be understood, these arrangements are merely exemplary, and in other arrangements, other configurations may be used.

Figure 3:
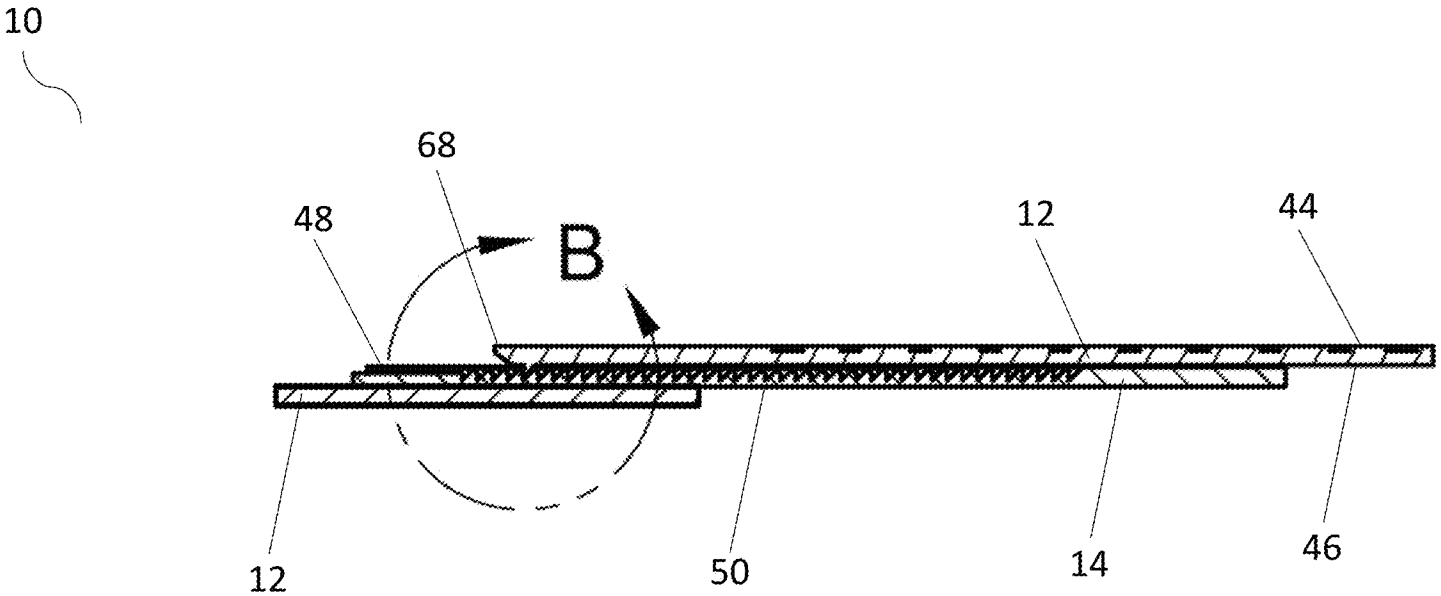
FIG. 3 is a bottom cross-section view of an exemplary size adjustment system.

Now referring to FIG. 3, there is shown therein an exemplary arrangement of system 10 in which the first piece or body 12 and the second piece or flexible strap piece 14 extend adjacent one another in operatively interlocked relation. The exemplary first piece 12 includes a longitudinally extending, generally planar outer face 44 and an inner face 46. The outer face 44 is disposed away from the second piece 14, and the inner face 46 is disposed toward the second piece 14. The exemplary second piece 14 includes a longitudinally extending, generally planar outer face 48 and an inner face 50. The exemplary inner face 46 of piece 12 and outer face 48 of piece 14 extend in adjacent, facing relation. As will be explained in further detail later, the exemplary first piece 12 includes a deck portion and a landing portion that are operatively connected to form an opening through which the exemplary second piece 14 is configured to extend in the opening in movable interlocked relation with the first piece 12. As can be appreciated, this arrangement is merely exemplary, and in other arrangements, other configurations may be used.

Figure 4:
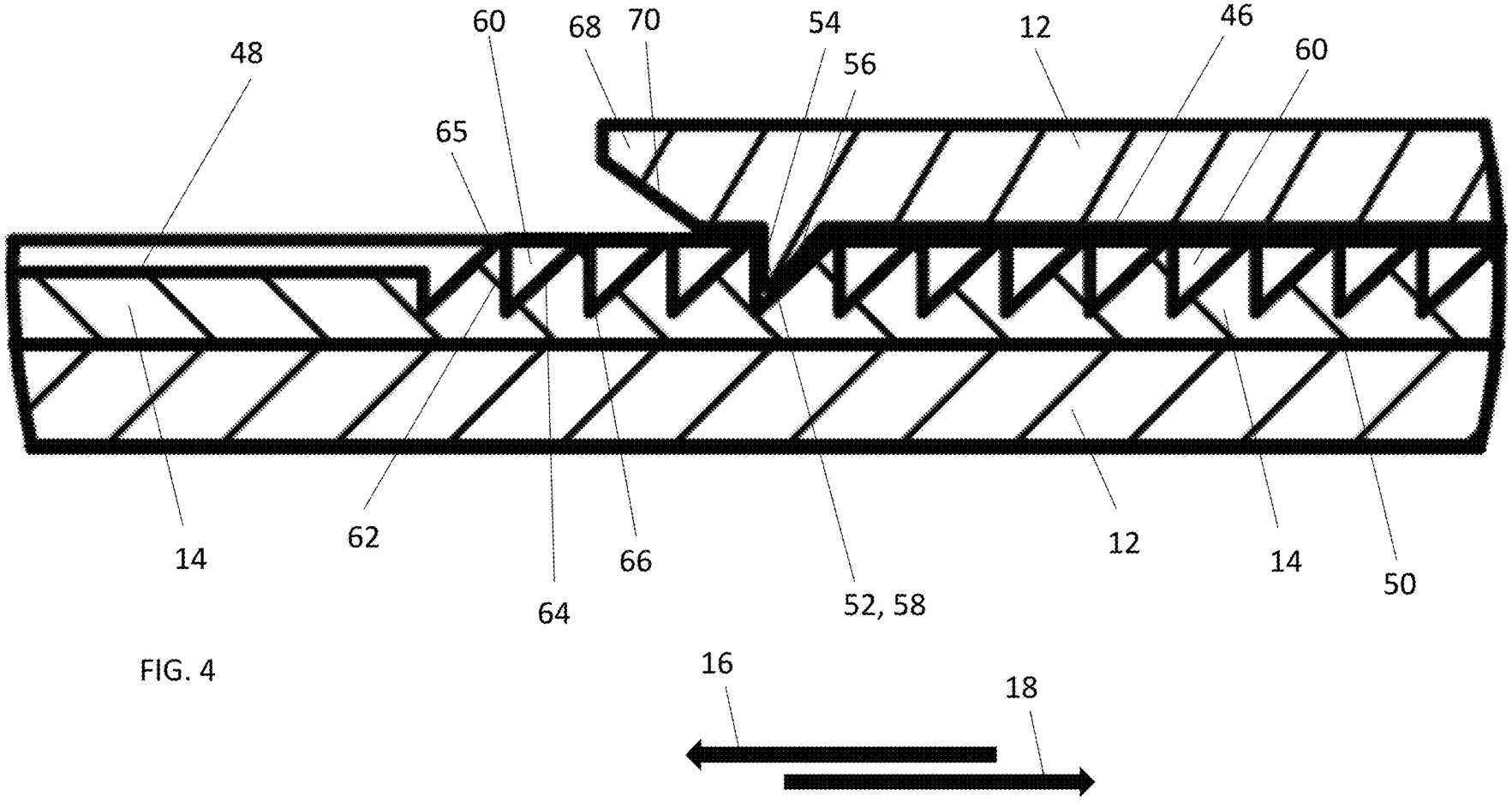
FIG. 4 is a bottom cross-section view of an exemplary size adjustment system.

Referring now to FIG. 4, there is shown therein an exemplary first piece or body 12 and an exemplary second piece or flexible strap piece 14. The exemplary body 12 is comprised of manually deformable material. The exemplary first piece 12 includes a movable engaging projection 52. The exemplary movable projection 52 is integrally formed with the body 12. The exemplary projection 52 extends generally perpendicular to the inner face 46 of piece 12 and toward the outer face 48 of piece 14. In alternative exemplary arrangements, the moveable projection 52, in transverse cross-section, includes an inwardly directed point or apex 58. In exemplary arrangements, the projection 52 includes a squared wall 54 and a beveled wall 56 that converge to form apex 58 at a distal end of the projection 52, disposed furthest from the inner face 46. In alternative exemplary arrangements, the projection 52 may comprise any shape operative to engage one of a projection or recess, as will be hereafter discussed.

The exemplary second piece or flexible strap piece 14 is elongated in the longitudinal direction. The exemplary second piece 14, in transverse cross-section, includes a pair of parallel, opposed sides. The exemplary parallel, opposed sides are also referred to herein as outer face 48 and inner face 50. In exemplary arrangements, at least one of the sides 48 and 50 includes a plurality of longitudinally spaced projections or recesses 60. In certain exemplary arrangements, a plurality of recesses or projections 60 extend in close adjacent relation to one another along the outer face 48 of piece 14. The exemplary recesses or projections 60 extend in the outer face 48 of piece 14 toward the inner face 50 on the opposing side of the second piece 14. In transverse cross-section, the exemplary projections or recesses 60 each include a squared wall 62 and a beveled wall 64 that converge at their most distal end from outer face 48 to form a crest 65, and converge at their most proximal end to outer face 48 to form a trough 66. In alternative exemplary arrangements, the recesses or projections 60 may comprise any shape that is operative to receive a projection in engaged relation therewith.

In exemplary arrangements, the plurality of recesses or projections 60 are arranged such that there are approximately five recesses or projections within one centimeter (cm) on the outer face 48 of second piece 14. That is, a respective trough 66 is disposed apart from the immediately adjacent troughs a distance of 0.2 cm. However, in alternative exemplary arrangements, a respective trough of one of the plurality of recesses or projections 60 is disposed from the trough of the immediately adjacent recesses or projections 60 a distance within a range of 0.1 cm to 0.5 cm. Of course, this arrangement of the plurality of recesses or projections is merely exemplary, and in other arrangements, other configurations may be used.

In exemplary arrangements, in an undeformed position of the first piece or body 12, the engaging projection 52 is configured to extend in one of the plurality of recesses or projections 60 in engaged relation. In an engaged position of the projection 52 and a recess or projection 60, the beveled wall 56 of the projection is in operatively contacting relation with the beveled wall 64 of the recess or projection. Further, the squared wall 54 of the projection and the squared wall 62 of the recess or projection are in operatively parallel, contacting relation. Still further, the apex 58 of the projection is in contacting, fitting relation with the trough 66 of the recess or projection. The contacting relation of the beveled walls of projection 52 and the recess or projection 60 is operative to resist movement of the recess or projection 60 relative to the projection 52 in the second longitudinal direction indicated at arrow 18, thereby resisting movement of the second piece or flexible strap piece 14 relative to the first piece or body 12 in the second longitudinal direction. Further, the contacting relation of the squared wall 54 and the squared wall 62 prevent movement of the recess 60 relative to projection 52 in the first longitudinal direction indicated at arrow 16, thereby preventing movement of the second piece 14 relative to the first piece 12 in the first longitudinal direction. In other words, in an undeformed position of the body 12, as shown in FIG. 4, the point 58 of the movable projection 52 is in engagement with at least one of the longitudinally spaced projections or recesses 60, whereby the flexible strap piece 12 is held longitudinally fixed. Of course, these arrangements are merely exemplary, and in other arrangements, other structures and configurations may be used.

It should be understood that in alternative exemplary arrangements, the configuration may be reversed so that projection 52 extends from the outer face 48 of piece 14 and toward piece 12, and the recesses or projections 60 extend in and along the inner face 46 of piece 12. Further, the exemplary system may be configured such that the first piece 12 is movable relative to the second piece 14.

Still referring to FIG. 4, the exemplary first piece 12 further includes a manually engageable tab 68. The exemplary tab 68 is operatively positioned in close proximity to the projection 52. The exemplary manually engageable tab 68 is integrally formed with the first piece or body 12 and is integrally formed with the movable projection 52. In exemplary arrangements, the tab 68 is positioned at an end of the first piece 12 disposed toward the first side 40 of the U-shaped opening 36. The exemplary tab 68 includes a beveled wall 70 that slopes away from the first side 40 toward the second piece 14. As will be discussed in more detail later, the exemplary first piece 12 includes a flexible or deformable portion intermediate of the tab 68 and the body 12 such that the tab 68 is engageable by a user to cause the projection 52 to be removed from the recesses or projections 60. In this disengaged position or deformed position of the projection 52 and the recesses or projections 60, a user is enabled to manipulate the second piece 14 to move longitudinally in the first or second direction relative to the first piece 12.

As will also be discussed in greater detail later, when the user has moved the second piece 14 relative to the first piece 12 to the desired position such that the system 10 has adjusted the size of the hat to the user's liking, the tab 68 is then disengaged by the user. As also will be discussed in more detail later, the disengagement of the tab 68 by the user causes the engaging projection to move into the nearest recess or projection 60 and causes re-engagement of the projection 52 and a recess or projection 60, thereby locking the system 10 and resisting unwanted longitudinal movement of the first piece 12 relative to the second piece 14 in either the first direction or the second direction. In other words, when the user ceases manual deforming engagement of the body 12, the point 58 and the projection or recess 60 return to an engaged position. However, this arrangement is merely exemplary, and in other arrangements, other approaches may be used.

Now referring to FIGS. 5-8, there is shown therein an exemplary first piece or body 12. The exemplary first piece 12 includes the attachment portion 20, the outer face 44, the inner face 46, the engaging projection 52, and the tab 68. The exemplary first piece 12 further includes a landing surface 72 which is alternatively referred to herein as a landing. The exemplary landing 72 includes a generally planar surface and extends generally longitudinally. The exemplary landing 72 is in operative fixed connection with the inner face 46. The exemplary landing 72 extends in underlying relation of the tab 68 and extends in the second direction indicated at arrow 18 to a point intermediate of the tab 68 and the second side 42 of the U-shaped opening 36. The exemplary landing 72 extends in the first direction indicated at arrow 16 to at least the first side 40 of the U-shaped opening 36. However, this arrangement is merely exemplary, and in other embodiments, other arrangements may be used.

Figure 5:
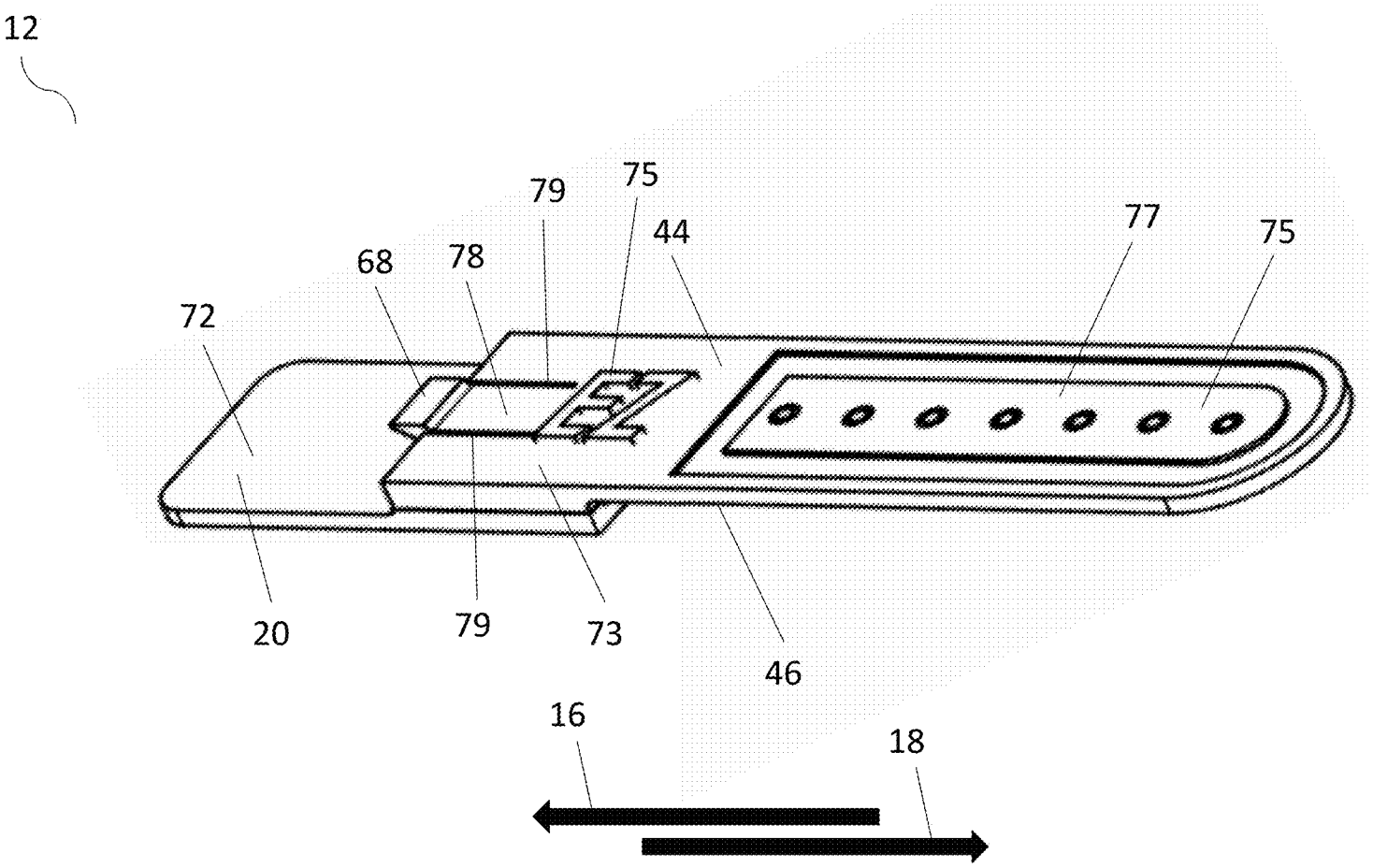
FIG. 5 is a bottom right perspective view of an exemplary first piece of an exemplary size adjustment system.
Figure 8:
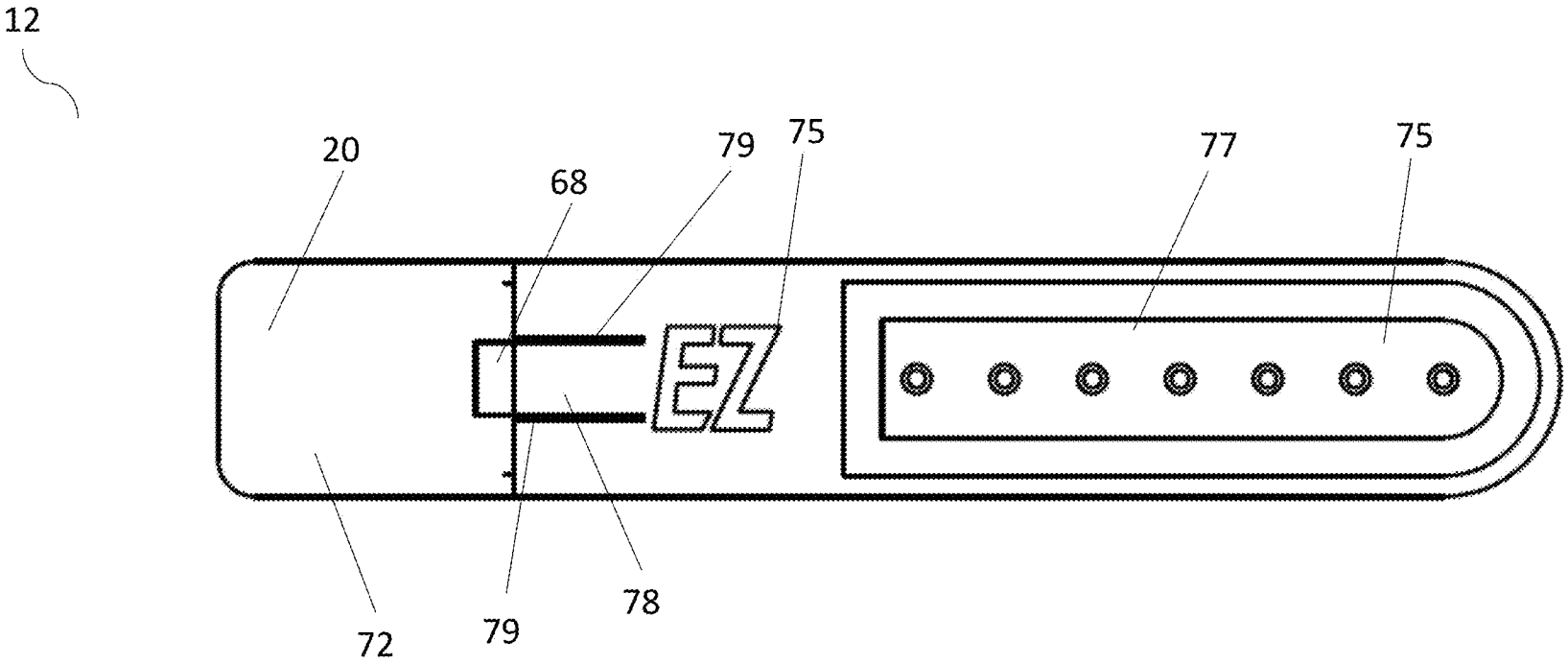
FIG. 8 is a front plan view of an exemplary first piece of an exemplary size adjustment system.

The exemplary first piece 12 further includes a deck 73. The deck 73 extends in partially overlying relation of the landing 72. The deck 73 includes a portion of the inner face 46 that is disposed in facing relation with the landing 72. The exemplary deck 73 includes an extension 77, also referred to herein as a floating strap extension 77, which includes indicia 75. For example, the indicia are best shown in FIGS. 5 and 8 and may comprise features that can be tactilely sensed such as a raised logo and a raised panel portion including openings or raised circular shapes disposed thereon. In exemplary arrangements, the indicia 75, comprise raised or lowered areas from the outer faces of the first or second piece. The indicia 75 comprise manually tactilely identifiable projections or recesses that are in aligned relation with and adjacent to the tab 68, which enable a user to tactilely locate the tab or area of manual engagement of the body 12 for deformation of the body 12, in order to cause the body 12 to change to the deformed position. As used herein when it is stated that the indica are in aligned relation with the tab or other deformable portion of the body it is meant that the indicia may be on the tab or area to be deformed and/or the indicia may be arranged so that the user can follow the indicia by touch to the area to be deformed. However, as can be appreciated, the described indicia are merely exemplary, and in other arrangements, other types of indicia may be used.

In exemplary arrangements, the floating strap extension 77, aside from being in operative fixed connection with the deck 73, is free floating relative to the other portions of the system 10. The extension 77 is integrally formed with the body 12, is disposed on the body 12 on a side opposite of the moveable projection 52, and extends in the longitudinal direction in overlapping relation of the flexible strap piece 14.

Figure 7:
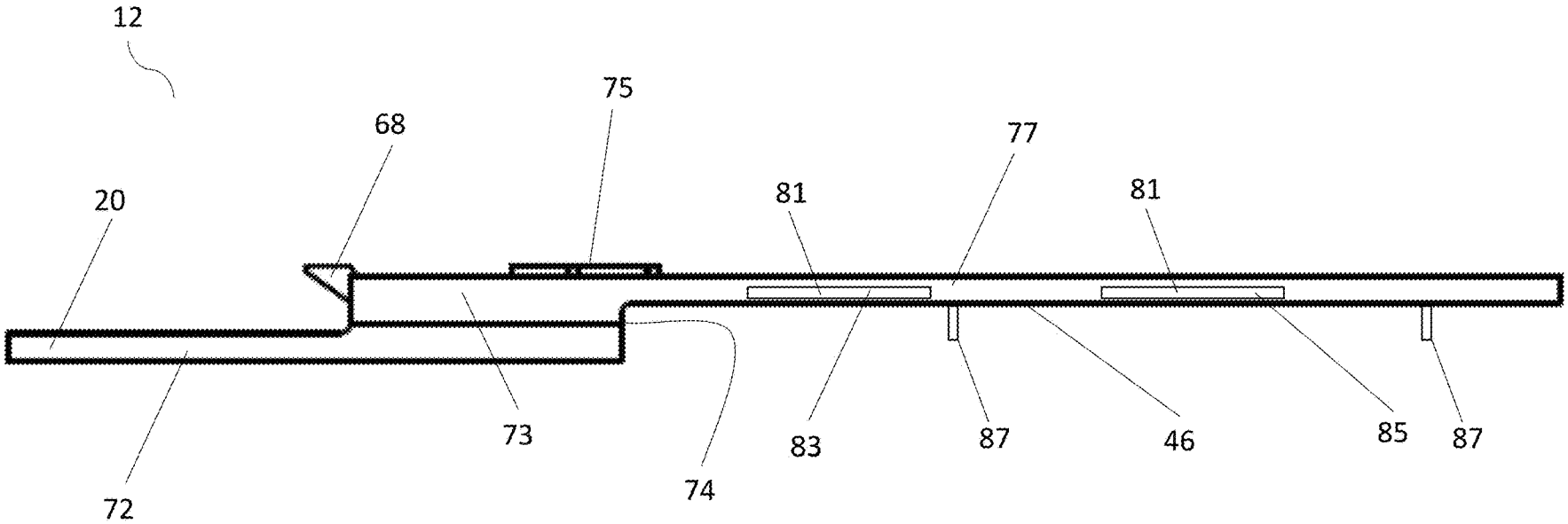
FIG. 7 is a bottom plan view of an exemplary first piece of an exemplary size adjustment system.
Figure 9:
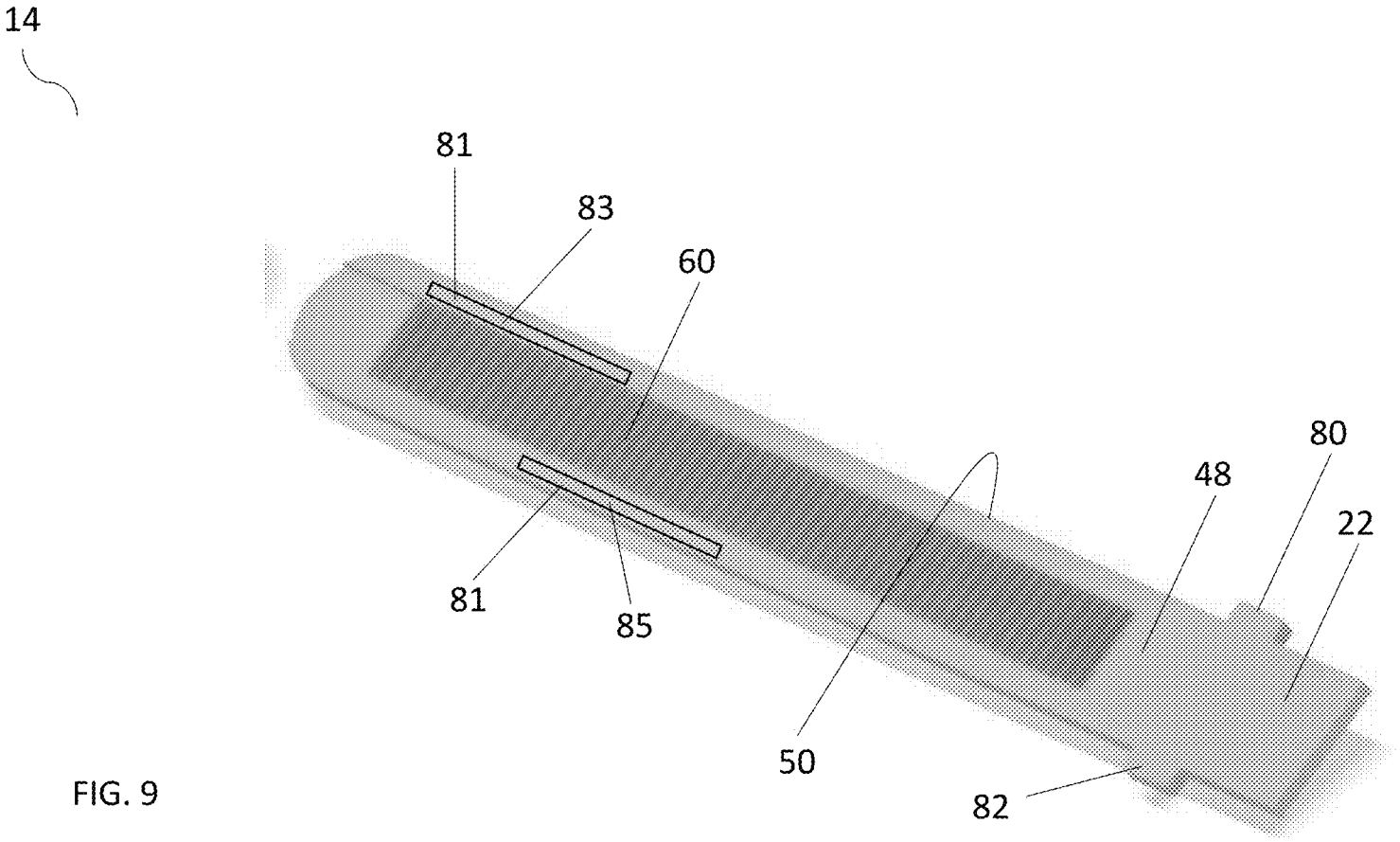
FIG. 9 is a front right perspective view of an exemplary second piece of an exemplary size adjustment system.

As best shown in FIGS. 7 and 9, in alternative exemplary arrangements, the exemplary system 10 includes a floating strap extension retainer 81. The exemplary floating strap extension retainer 81 comprises structures or systems to maintain the extension 77 in close, overlaying proximity to the second piece 14. The exemplary floating strap extension retainer is in operative connection with at least one of the body 12 and the flexible strap piece 14. In exemplary arrangements, the floating strap extension retainer 81 is configured such that the exemplary extension piece 77 and the second piece 14 include at least one magnet such as magnets 83 and 85 that attract the inner face 46 of extension piece 77 toward the outer face 48 of the second piece 14. In alternative exemplary arrangements, at least one of the inner face 46 of the extension 77 and the outer face 48 of the second piece 14 include a rail structure, and the other includes a guide structure. The exemplary rail and guide structure are configured to be slidably engageable along the outer face 48 and inner face 46. The engagement of the exemplary rail and guide structure is configured to maintain the extension piece 77 in close proximity to the second piece 14 such that the extension piece 77 does not freely move away from the piece 14, thereby avoiding unwanted space therebetween and preventing the extension piece 77 from extending away from the second piece 14 at an undesirable angle or in an undesirable location.

Further, the exemplary system 10 may include a retaining loop 87 that is in operative connection with one of the first piece and the second piece 14 and extends in encircling or enclosing relation around the other of the first piece 12 and the second piece 14 to keep the first piece 12 and the second piece 14 in close proximity to each other during use of the system 10. In exemplary arrangements, the retaining loop 87 extends from the body 12 opposite of the outer face 44 toward the flexible strap piece 14 and is configured to receive the flexible strap piece 14 therethrough to maintain the body 12 in close proximity to the outer face 48 of the flexible strap piece 14. As can be appreciated, these structures for maintaining the extension piece in close proximity to the second piece are merely exemplary, and in other arrangements, other structures and approaches may be used.

Figure 6:
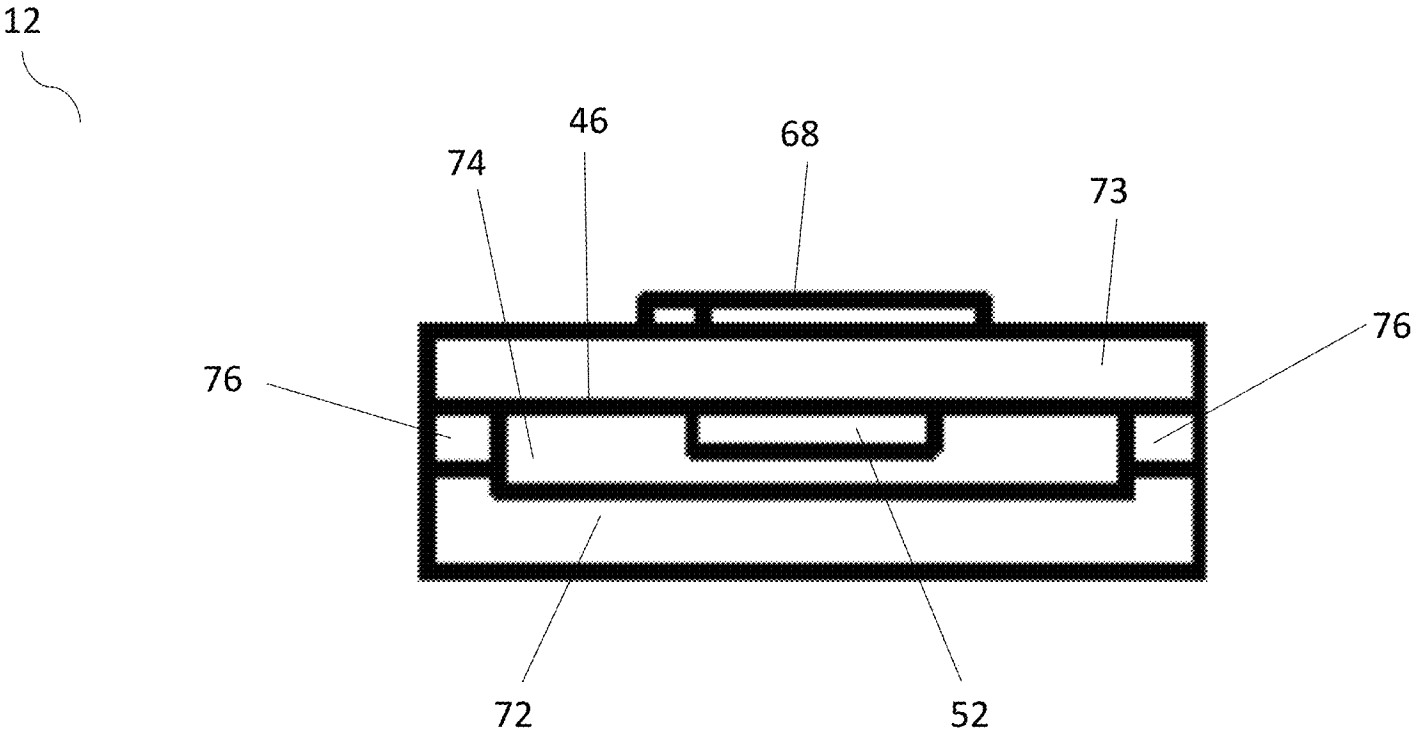
FIG. 6 is a right-side cross-section view of an exemplary first piece of an exemplary size adjustment system.

As best shown in FIGS. 5-6, the exemplary first piece or body 12 includes a receiving opening 74. The exemplary body opening 74 extends generally longitudinally and is generally rectangular in transverse cross-section. By generally rectangular it is meant that the four sides of the opening have bounding structures however, such structures need not be continuous. The exemplary receiving opening 74 is bounded vertically by the landing 72 at its bottom and the inner face 46 at its top. The exemplary opening 74 is bounded laterally by sidewalls 76. As will be later discussed, the receiving opening 74 is configured to receive the second piece 14 therein. In alternative exemplary arrangements, the landing 72 and the inner face 46 both include recessed portions in the opposing surfaces thereof to form the receiving opening 74. Of course, this arrangement is exemplary, and in other arrangements, other approaches may be used.

In exemplary arrangements, the exemplary first piece 12 further includes a flexible portion 78. The exemplary flexible portion 78 is included on an end of the tab 68 adjacent the attachment portion 20 of piece 12. The exemplary flexible portion 78 is in operative connection with the deck 73 of piece 12 at an end disposed away from the tab portion 68. In alternative exemplary arrangements, the flexible portion 78 is integrally formed with the deck 73. The exemplary flexible portion 78 is configured such that the flexible portion 78 is operative to cause the tab 68 and the engaging projection 52 to be biased toward the landing 72, such that when the second piece 14 extends within the receiving opening 74, the projection 52 is biased toward engagement with a recess or projection 60. That is, in an undeformed position of the body 12 or in an undeformed position of the tab at 68, the flexible portion 78 is operative to bias the movable projection 52 toward engagement with the projections or recesses 60. This biasing causes the apex of the engaging projection 52 to extend in a recess or projection 60, and the engagement of the moveable projection 52 and the projection and recesses 60 prevents longitudinal movement of the second piece 14 relative to the first piece 12 in either the first or second longitudinal direction. As will be discussed later, the biasing caused by the flexible portion 78 of the engaging projection 52 toward the second piece 14 and the landing 72 maintains the first piece 12 and the second piece 14 in an interlocked, immovable relation until a user applies a disengaging or deforming force to the tab 68. As should be understood, this arrangement is merely exemplary, and other approaches and arrangements may be used.

The exemplary deck 73 includes gaps 79 adjacent the flexible portion 78 that provide space between the flexible portion 78 and surrounding portions of the deck 73. The gaps 79 permit the flexible portion 78 to move upward and downward relative to the surrounding portions of the deck 73. In other words, the gaps 79 permit the tab 68 to be moved toward and away from the landing 72, as a result of the function of the flexible portion 78. The exemplary gaps 79 extend within the deck 73 from the outer face 44 to the inner face 46 of first piece 12, in parallel relation with each other, and extend generally parallel with the longitudinally extending first piece 12 and second piece 14. Of course, this arrangement is merely exemplary, and other approaches and arrangements may be used.

FIG. 9 shows an exemplary second piece or flexible strap piece 14 of the exemplary system 10. The exemplary second piece 14 includes the attachment portion 22, the outer face 48, the inner face 50, and the plurality of recesses or projections 60. The exemplary second piece 14 further includes gripping portions, also referred to herein as manually engageable outward extending projections, 80 and 82. As will be later discussed, the projections 80 and 82 are configured to be manually engageable by a user to cause movement of the flexible strap piece 14 relative to the first piece or body 12 in either the first 16 or second longitudinal direction 18. This arrangement of the second piece is merely exemplary, and in other arrangements other approaches may be used.

Figure 10:
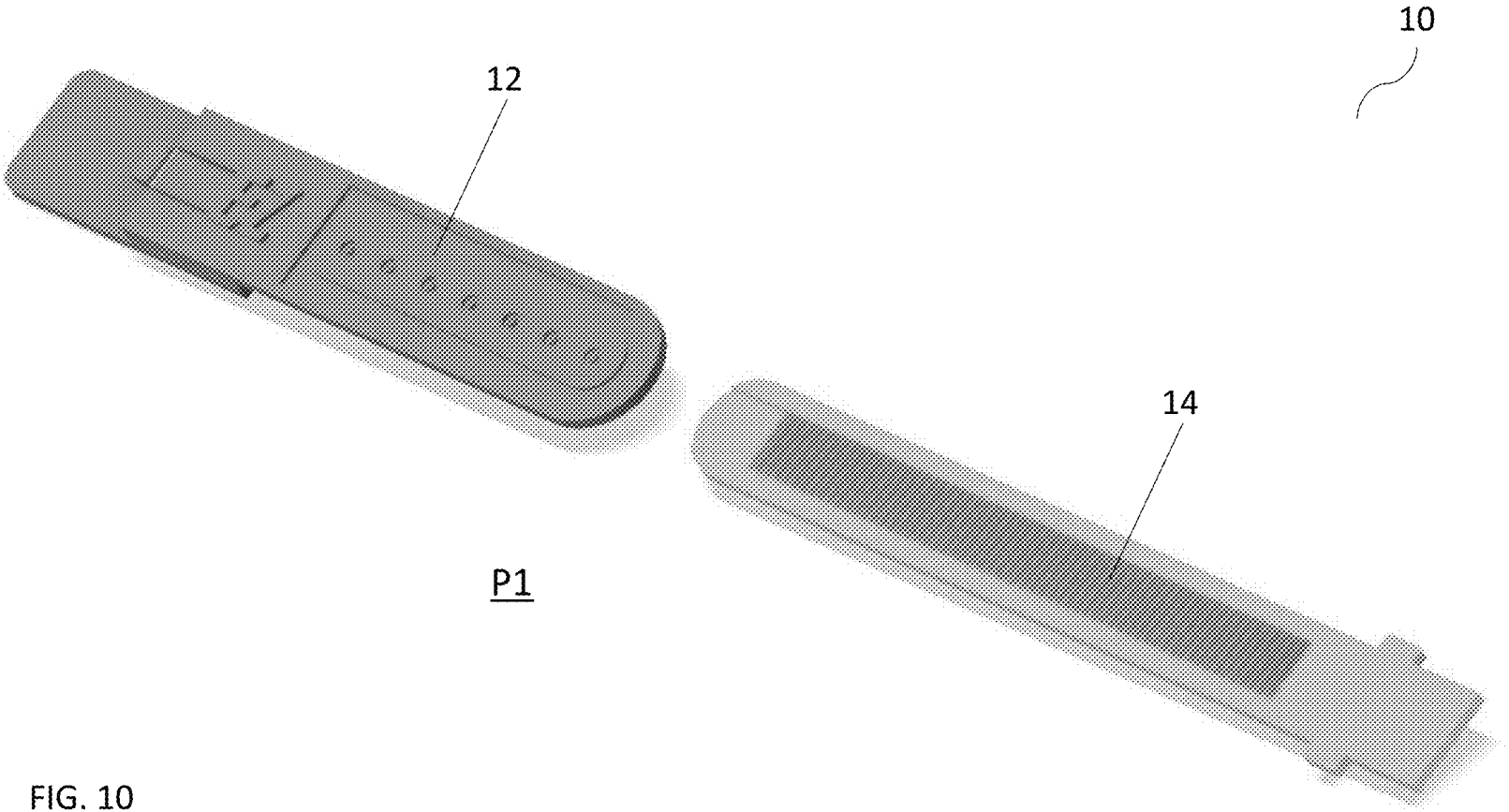
FIG. 10 is a front right perspective view of an exemplary first piece and an exemplary second piece of an exemplary size adjustment system.
Figure 11:
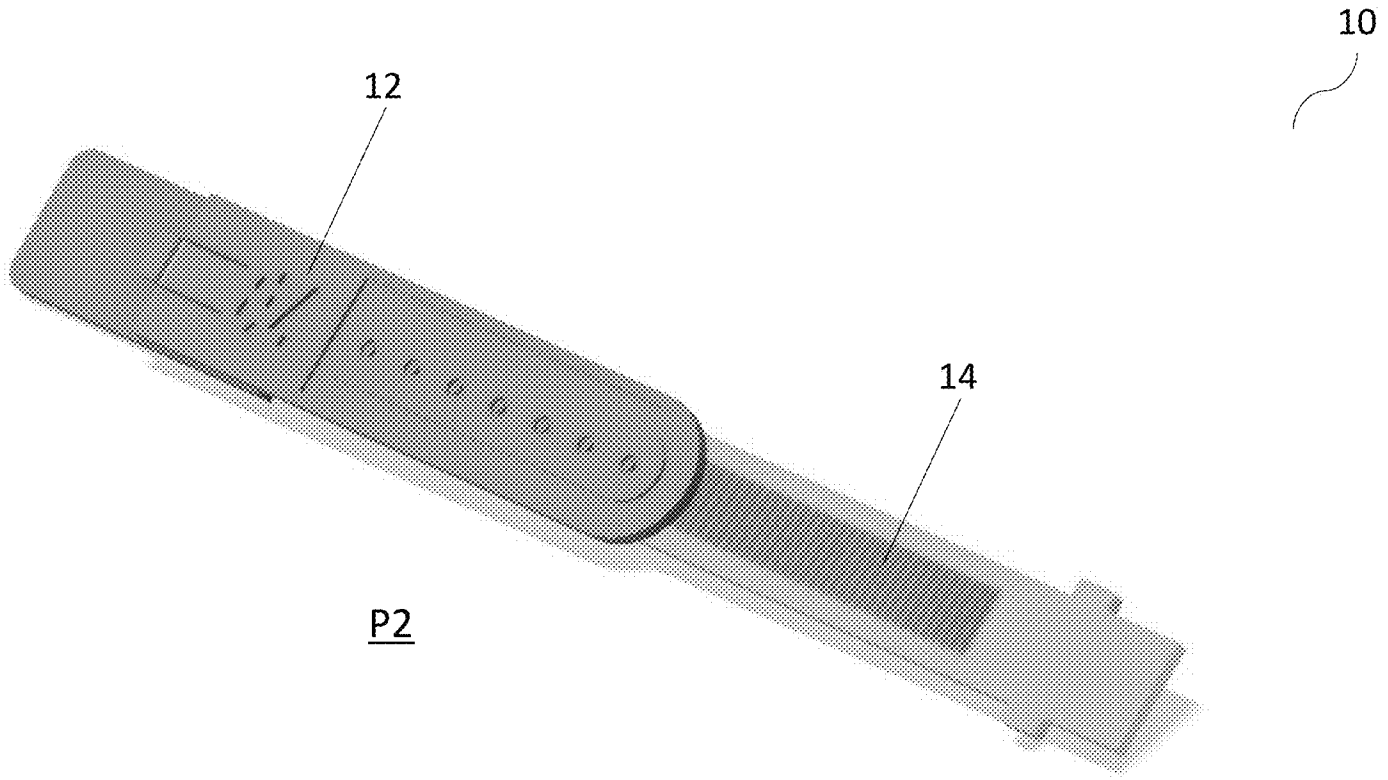
FIG. 11 is a front right perspective view of an exemplary first piece and an exemplary second piece of an exemplary size adjustment system in an engaged state.
Figure 12:
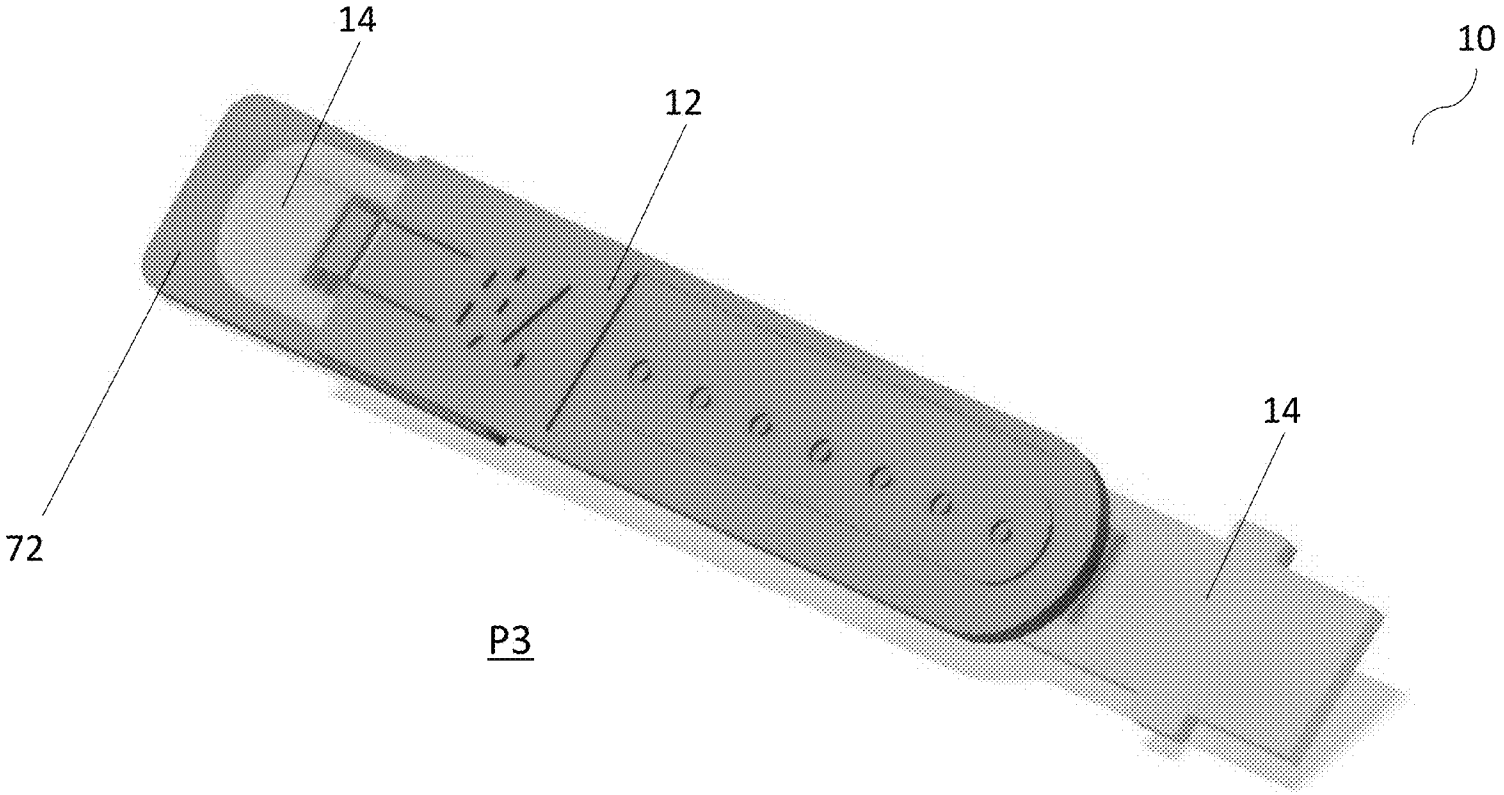
FIG. 12 is a front right perspective view of an exemplary first piece and an exemplary second piece of an exemplary size adjustment system in an engaged state.
Figure 13:
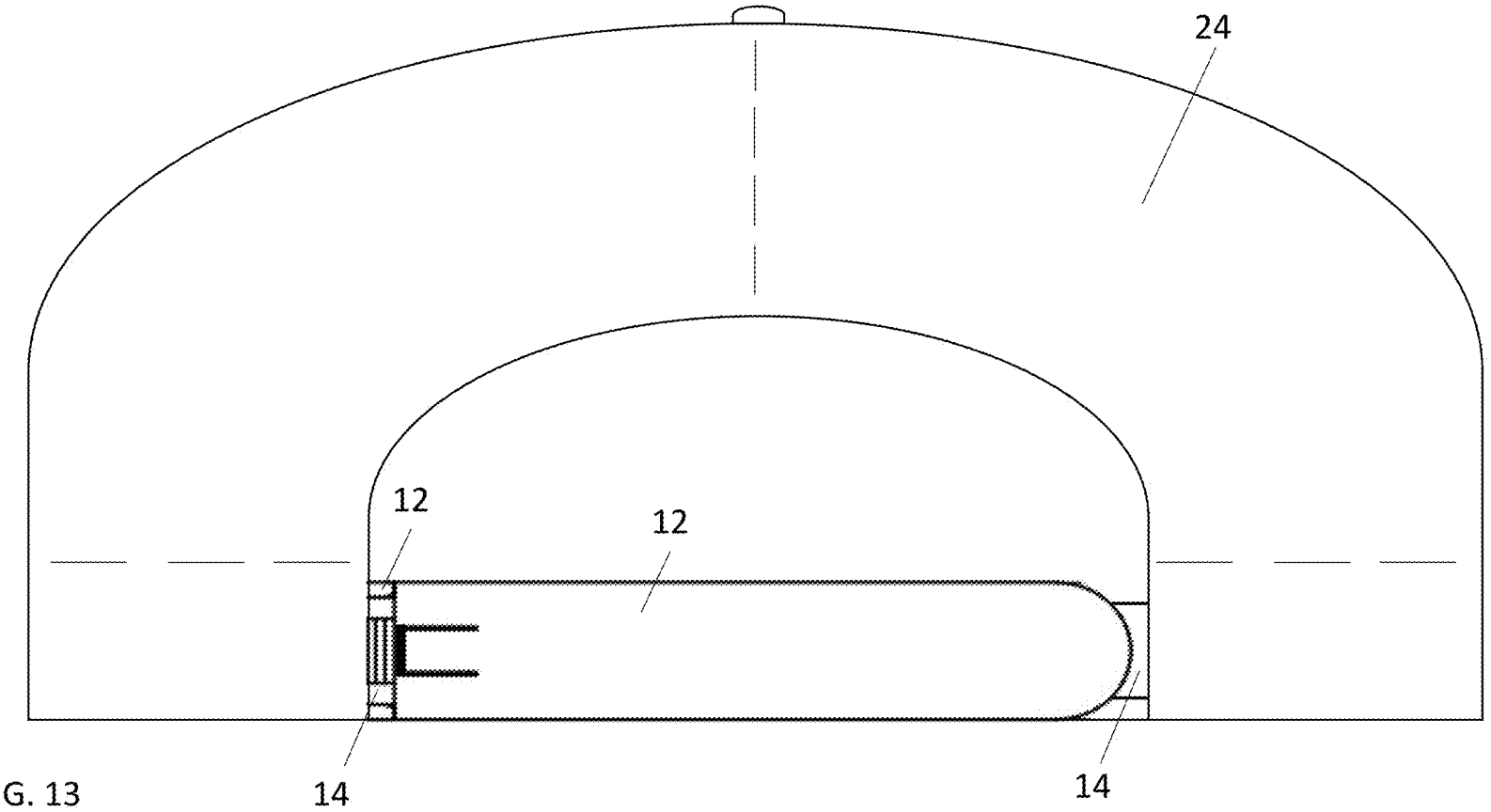
FIG. 13 is a front plan view of an exemplary size adjustment system in an interlocked condition in operative connection with an exemplary hat.

Now referring to FIGS. 10-13, there is shown therein the exemplary system 10. In FIG. 10, the exemplary system 10 is shown in a position P1, in which pieces 12 and 14 are separated from one another. In FIG. 11, the exemplary system 10 is shown in a position P2, in which pieces 12 and 14 are approaching the interlocked condition, the second piece 14 has been moved in the first direction toward the first piece 12. In FIG. 12, the exemplary system 10 is shown in a position P3, in which the first piece 12 and the second piece 14 are in an interlocked condition. In this interlocked condition, second piece 14 extends through the opening 74 and the moveable projection 52 is positioned in engagement with one of the recesses or projections 60. Further, in the interlocked condition, the inner face 50 of the second piece 14 is in facing relation with the landing 72 and the outer face 48 of the second piece 14 is in facing relation with the inner face 46 of first piece 12. In this interlocked condition, and when the exemplary system 10 is in operative connection with the hat 24, the system 10 is operative to securely maintain the current size of the hat, as shown in FIG. 13.

Figure 14:
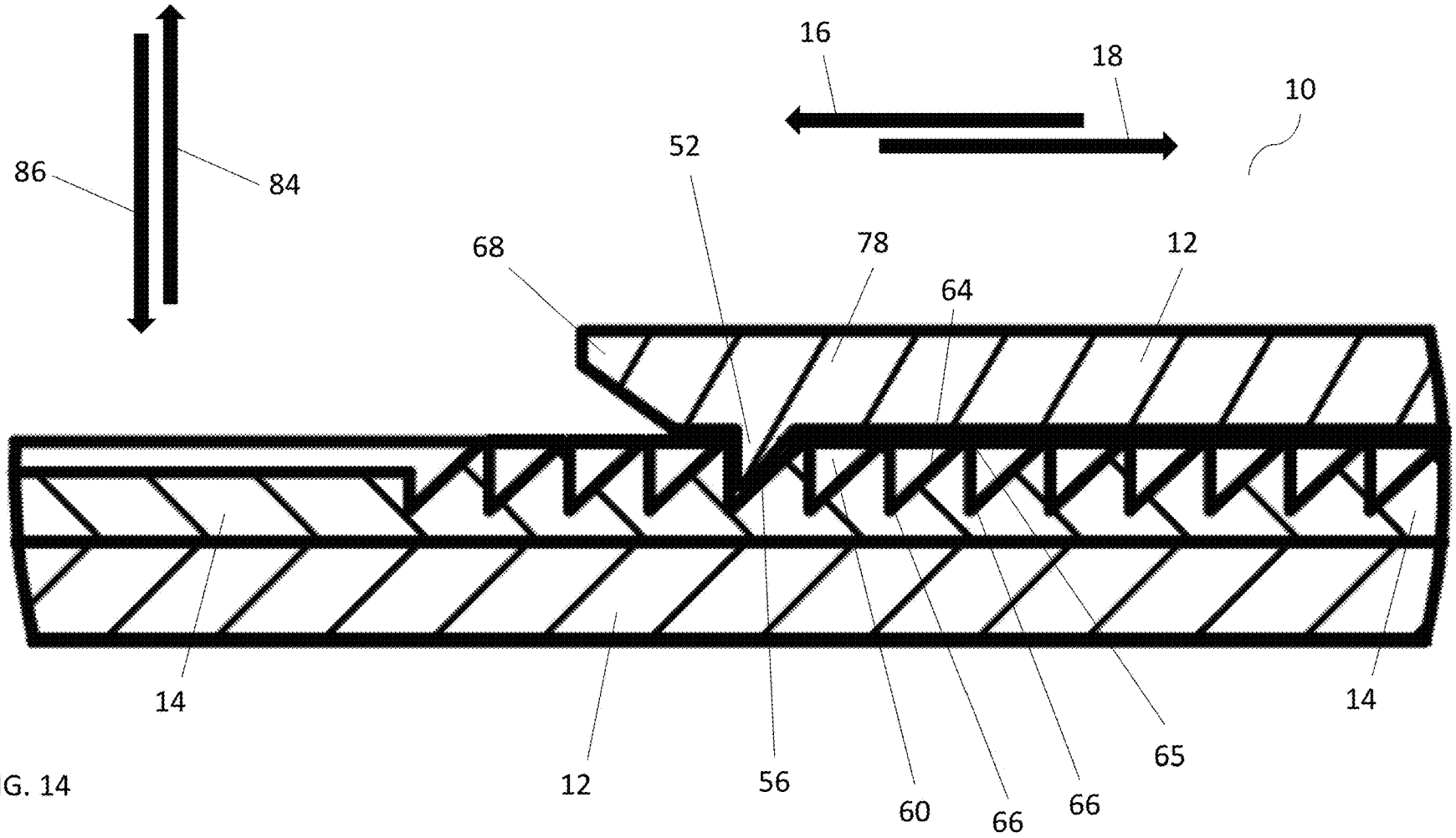
FIG. 14 is a bottom cross-section view of an exemplary size adjustment system.

Now referring to FIG. 14, there is shown therein a cross-section of the system 10 in position P3 in which the first piece or body 12 and the second piece or flexible strap piece 14 are in an interlocked condition of the exemplary system 10. In the interlocked condition, the body 12 and the tab 68 are in an undeformed position. In the interlocked condition of the exemplary system 10, the apex or point of the movable projection 52 is in engagement with one of the projections or recesses 60. The engaged relation of the projection 52 and the recesses or projections 60 resists movement of the second piece 14 relative to the first piece 12 in either the first longitudinal direction or the second longitudinal direction. When it is desired to adjust the size of the hat or other article of clothing, it is necessary to move the second piece 14 in either of the first direction or the second direction relative to the first piece 12. For example, if the user desires to adjust the size of the hat or article of clothing to a smaller size, the second piece 14 must be moved relative to the first piece 12 in the first direction. Conversely, if a user desires to adjust the size of the hat or article of clothing to a larger size, the second piece 14 must be moved relative to the first piece 12 in the second direction.

In order to adjust for a smaller size, the user simply engages the gripping portions or manually engageable outward extending projections 80 and 82 of the second piece 14 and moves the second piece 14 in the first direction relative to the first piece 12. That is, a user is not required to apply a disengaging force or a deforming force to the body 12 or tab 68 in order to adjust for a smaller size. Rather, the user merely needs to engage the outward extending projections 80 and 82 to move the flexible strap piece 14 in the first direction relative to the body 12. The movement of the second piece 14 relative to the first piece 14 is operative to automatically cause the projection 52 to slide up the beveled wall 64 of the recess or projection 60 in which the apex of the projection 52 was previously engaged. After sliding up the beveled wall 64 of the recess or projection 60, the projection 52 moves into and engages the immediately adjacent recess or projection 60 in the second direction. In other words, the projection 52 moves into the recess or projection 60 that is immediately adjacent in the second direction to the recess or projection 60 in which the projection 52 was previously engaged. This process of the projection 52 moving up a beveled wall of a recess or projection 60 and into the immediately adjacent recess or projection in the second direction is repeated until the user adjusts the size of the hat to the user's desired fit. When the user's desired fit has been obtained, the user simply stops applying force to the second piece 14 in the first direction, and the system 10 is operative to maintain the user's desired fit of the hat.

In alternative exemplary arrangements, in order to move the second piece or flexible strap piece 14 in the first direction relative to the first piece or body 12 to adjust for a smaller sizer, a user must apply an upward or outward force to the tab 68, for example, with at least one finger, such that the flexible portion 78 is sufficiently deformed or bent to permit the engaging projection 52 to be moved in a disengaging direction indicated at arrow 84 out of or otherwise disposed away from the recess or projection 60. Thereafter, or simultaneously, the user also engages the outwardly extending projections 80 and 82, for example, with at least one finger, to apply a force to the projections 80 and 82 sufficient to move the second piece 14 in the first direction relative to the first piece 12.

In exemplary arrangements, the tab 68 is moved in the disengaging direction indicated by arrow 84, a sufficient distance from the second piece 14 such that the engaging projection 52 is clear of contact with the beveled walls 64 of the recesses or projections 60 while the second piece 14 is moved in the first direction 16. In alternative exemplary arrangements, the tab 68 is moved in the disengaging direction 84 only slightly such that the pressure force between the beveled wall 56 of projection 52 and the beveled wall 64 of a recess or projection 60 is reduced a sufficient amount to enable the beveled walls 56 and 64 to slide relative to each other while the second piece 14 is moved in the first direction 16. For example, the tab 68 is moved in the disengaging direction 84 only slightly and the beveled wall 56 of projection 52 is enabled to slide up the beveled wall 64 of the recess or projection 60, to slide over the crest 65 disposed between troughs 66 of two adjacent recesses or projections, and to slide into engagement with the adjacent recess or projection 60. This process is repeated until the user has adjusted the hat or article of clothing to the desired fit.

After the user has adjusted the hat to the desired size and personalized fit, the user releases or ceases deformation of the tab 68. Release of the tab 68 by the user causes the movable projection 52 to move downward or inward in an engaging direction indicated at arrow 86, responsive to the biasing force of the flexible portion 78. The biasing force of the flexible portion 78 is operative to cause the engaging projection 52 to be moved in the engaging direction 86 and to have the apex of the projection become engaged with the nearest recess or projection 60 to the user's desired size. Re-engagement of the projection 52 and the nearest recess or projection 60 is operative to interlock the first piece 12 and the second piece 14 to resist unwanted longitudinal movement of the second piece 14 relative to the first piece 12.

Figure 15:
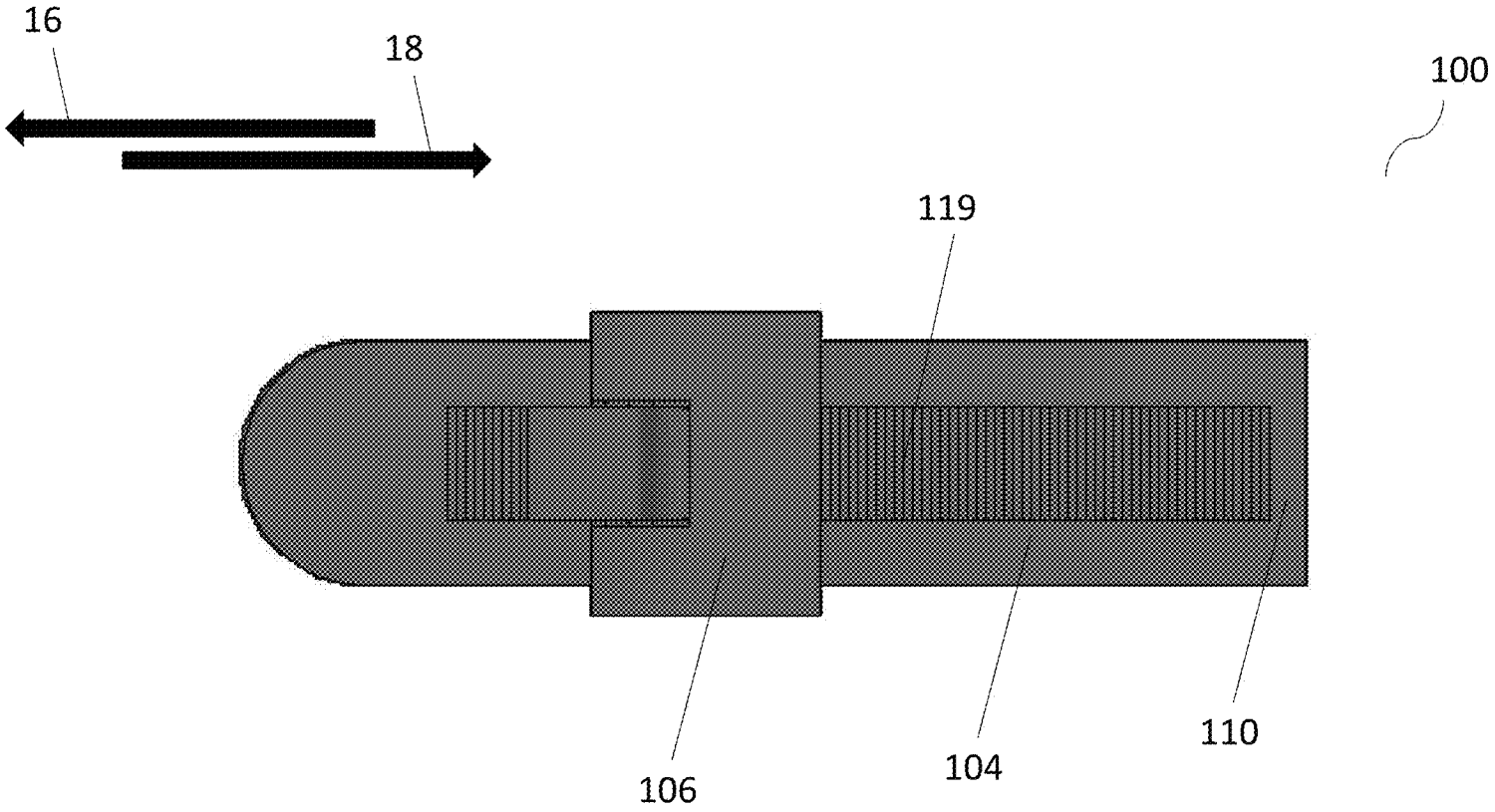
FIG. 15 is a front plan view of an exemplary alternative size adjustment system.
Figure 16:
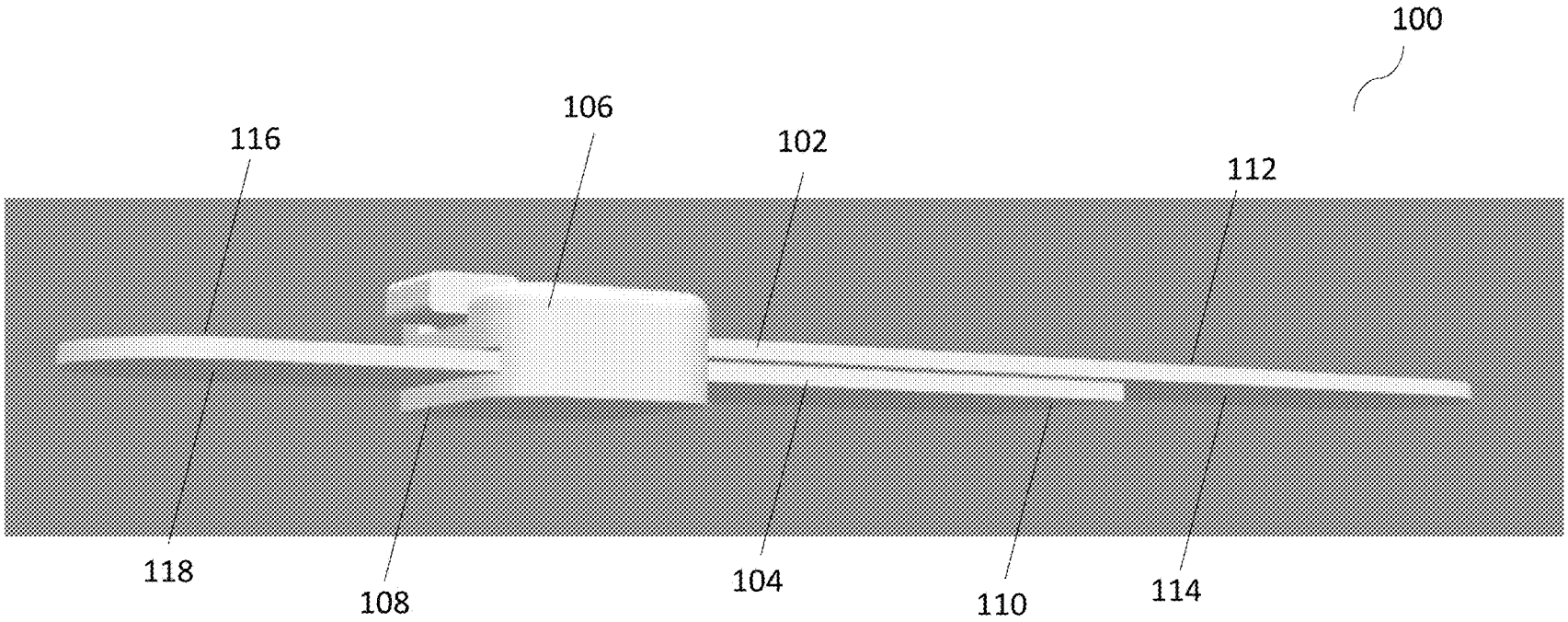
FIG. 16 is bottom left perspective view of an exemplary alternative size adjustment system.

Now referring to FIGS. 15-16, there is shown therein an alternative exemplary size adjustment system 100. The alternative exemplary size adjustment system 100 operates in a similar manner to the exemplary size adjustment system 10 to draw two portions of a hat or article of clothing toward each other, thereby creating a more personalized fit. However, the exemplary alternative size adjustment system 100 will be described in operative connection with a hat, but is not limited thereto. The alternative exemplary system 100 includes a first piece or body 102 (best shown in FIG. 16), a second piece or flexible strap piece 104, and a retainer box 106. The exemplary retainer box 106 which is alternatively referred to herein as a body is in operative fixed connection or integrally formed with the first piece 102 at an end thereof.

The exemplary first piece 102 includes an attachment portion 108 on the retainer box 106, and the exemplary second piece 104 includes an attachment portion 110. The exemplary attachment portions 108 and 110 are configured to be operatively attachable to or integrally formed with portions of an article of clothing such as a hat. The exemplary attachment portions 108 and 110 may be attached to the exemplary hat 24 through any of the attachment means or methods such as those described in connection with attachment portions 28 and 22.

In exemplary arrangements, the exemplary attachment portion 108 is operatively attached to or integrally formed with the outside surface 26 of the hat 24 adjacent the first side 40 of the U-shaped opening 36. In alternative exemplary arrangements, the exemplary attachment portion 108 includes an attachment extension (not shown) that extends from the retainer box 106 in the first direction 16 through the vertical slot 43 on the first side 40 and is operatively connected or attached to at least one of the inside surface 28 or the band 30, within slot 43.

The exemplary attachment portion 110 is operatively attached to or integrally formed with the outside surface 26 of the hat 24 adjacent the second side 42 of the U-shaped opening 36. In alternative exemplary arrangements, the exemplary attachment portion 110 extends in the second direction 18 through the vertical slot 45 on the second side 42 and is operatively connected or attached to at least one of the inside surface 28 or the band 30 within slot 45. However, these arrangements are merely exemplary, and in other arrangements, other approaches may be used.

The exemplary first piece 102 includes a longitudinally extending outer face 112 and an opposing longitudinally extending inner face 114. Outer face 112 is disposed away from the second piece 104, and the inner face 114 is disposed toward the second piece 104. Similarly, the exemplary second piece 104 includes an outer face 116 and an opposing inner face 118. The exemplary inner face 114 of the first piece 102 and the outer face 116 of the second piece 14 extend in adjacent, facing relation. The exemplary second piece 104 includes a plurality of recesses or projections 119, best shown in FIG. 15. The exemplary recesses or projections 119 may be similar to the recesses or projections 60 and include the squared and beveled walls such that a respective two converge at their bottom ends to form a trough, and another respective two converge at their top to form a crest. However, recesses and projections of other shapes may be used as well.

Figure 17:
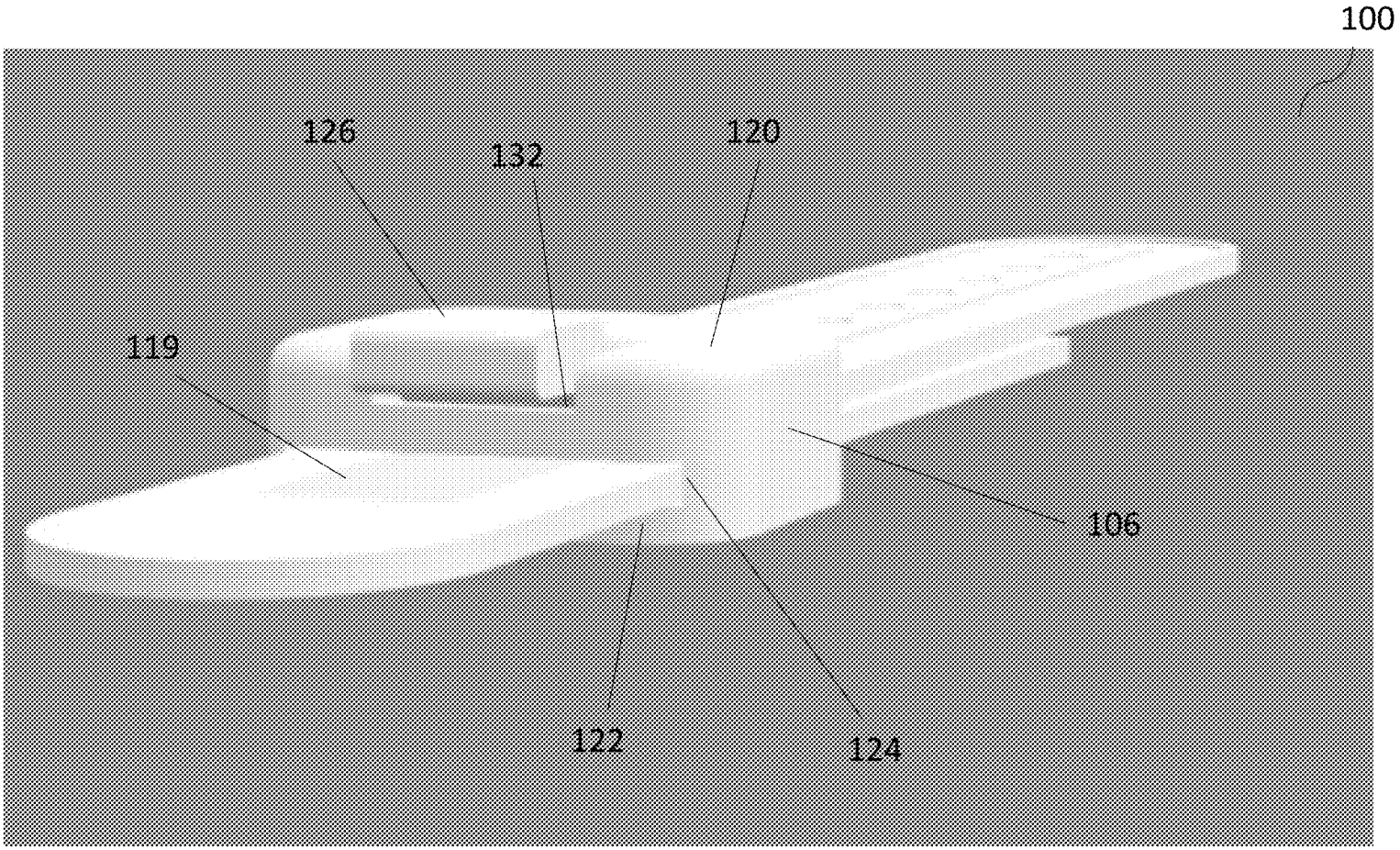
FIG. 17 is a front left perspective view of an exemplary alternative size adjustment system.
Figure 18:
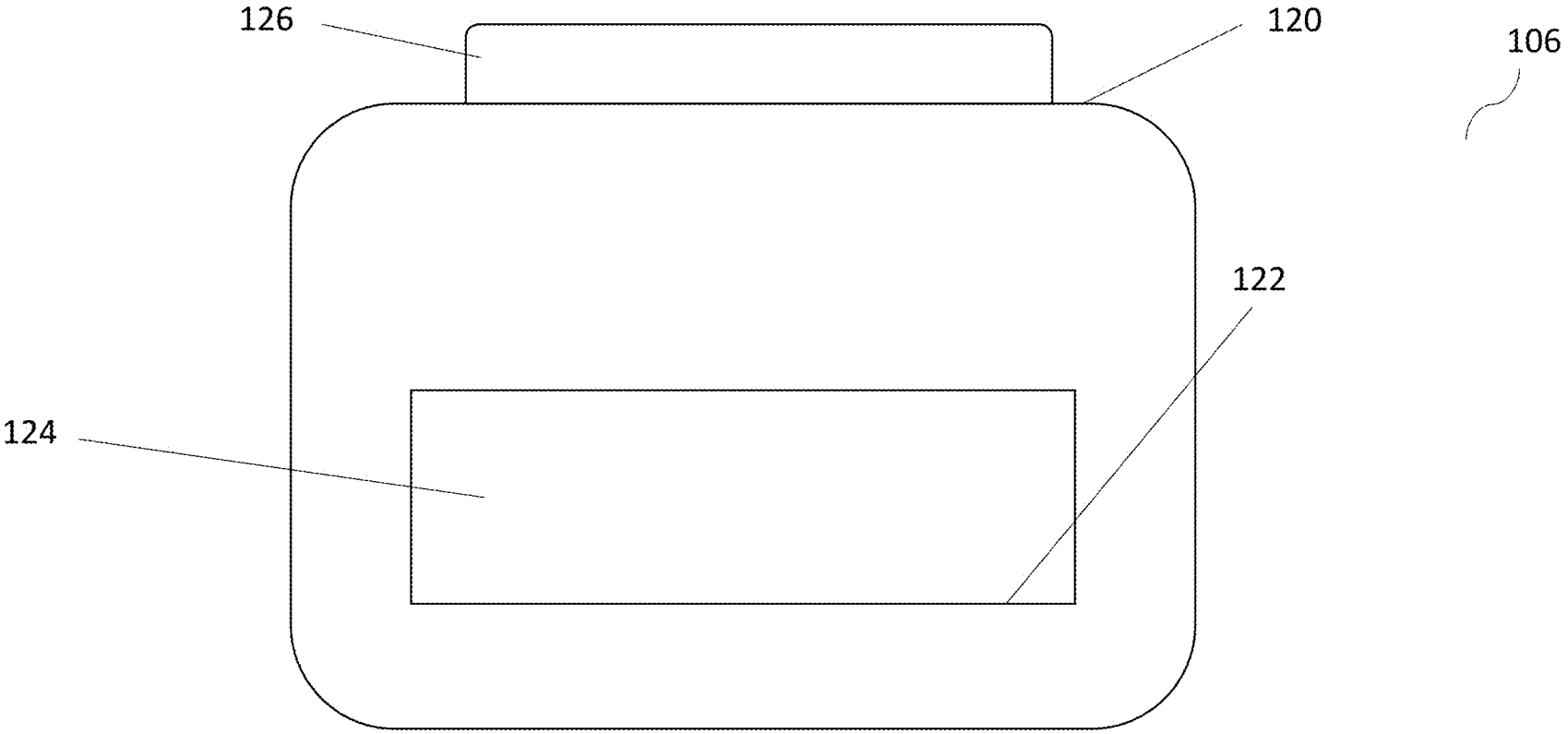
FIG. 18 is a right-side cross-section view of an exemplary retaining box of an exemplary alternative size adjustment system.
Figure 19:
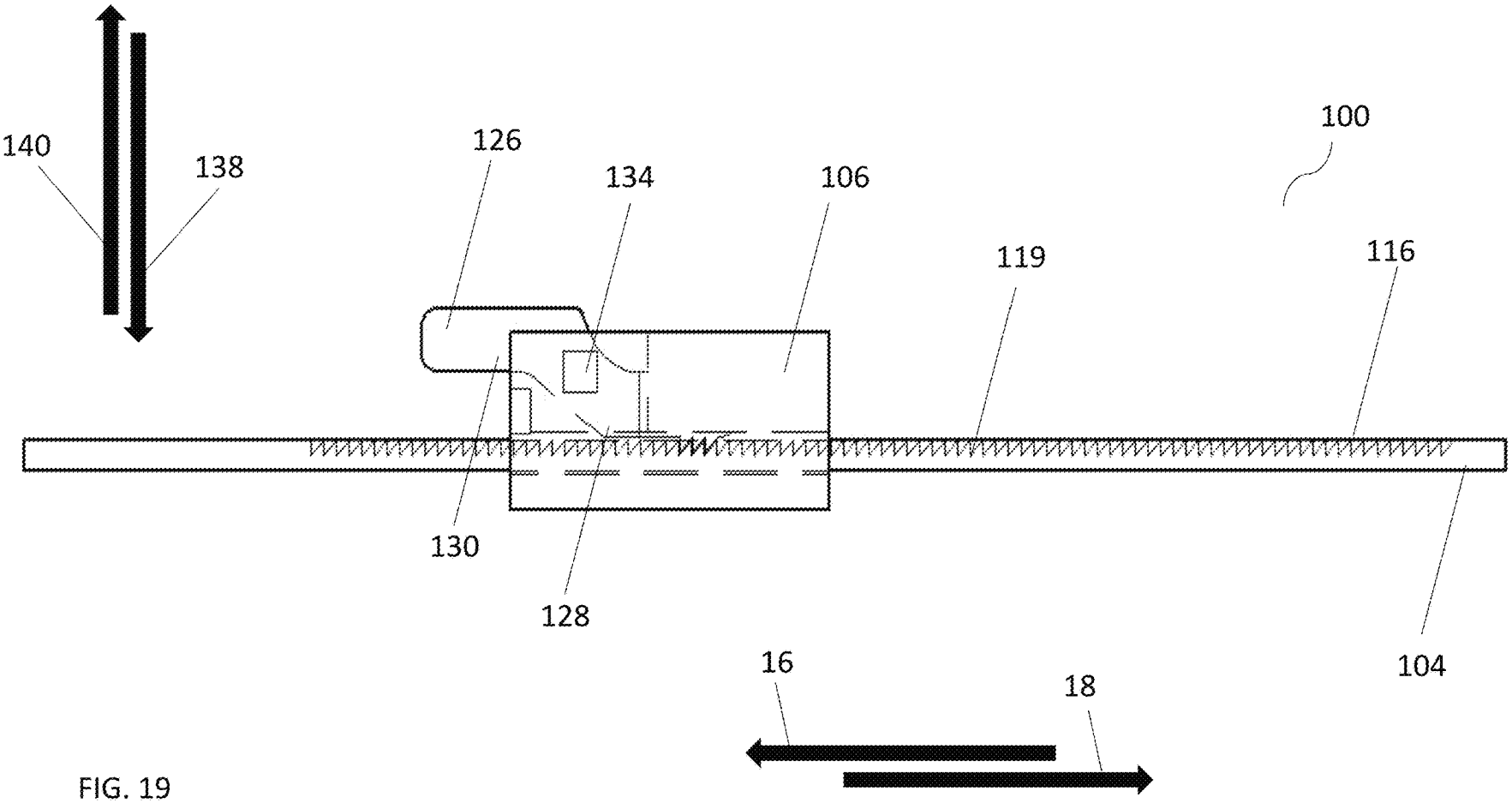
FIG. 19 is a bottom partial plan view of an exemplary alternative size adjustment system.

Now referring to FIGS. 17-19, in exemplary arrangements, the exemplary retainer box 106 comprises a generally rectangular or cube like body structure. The exemplary retainer box 106 includes a deck portion 120, a landing 122, and an opening 124. The exemplary retainer box 106 further includes a lever 126 and an engaging projection 128 (best shown in FIG. 19). The exemplary lever 126 and the engaging projection 128 are in operatively fixed connection to form a recess engaging mechanism 130, best shown in FIG. 19. The exemplary engaging mechanism 130 extends in a mechanism opening 132 that extends within the retainer box 106.

Figure 20:
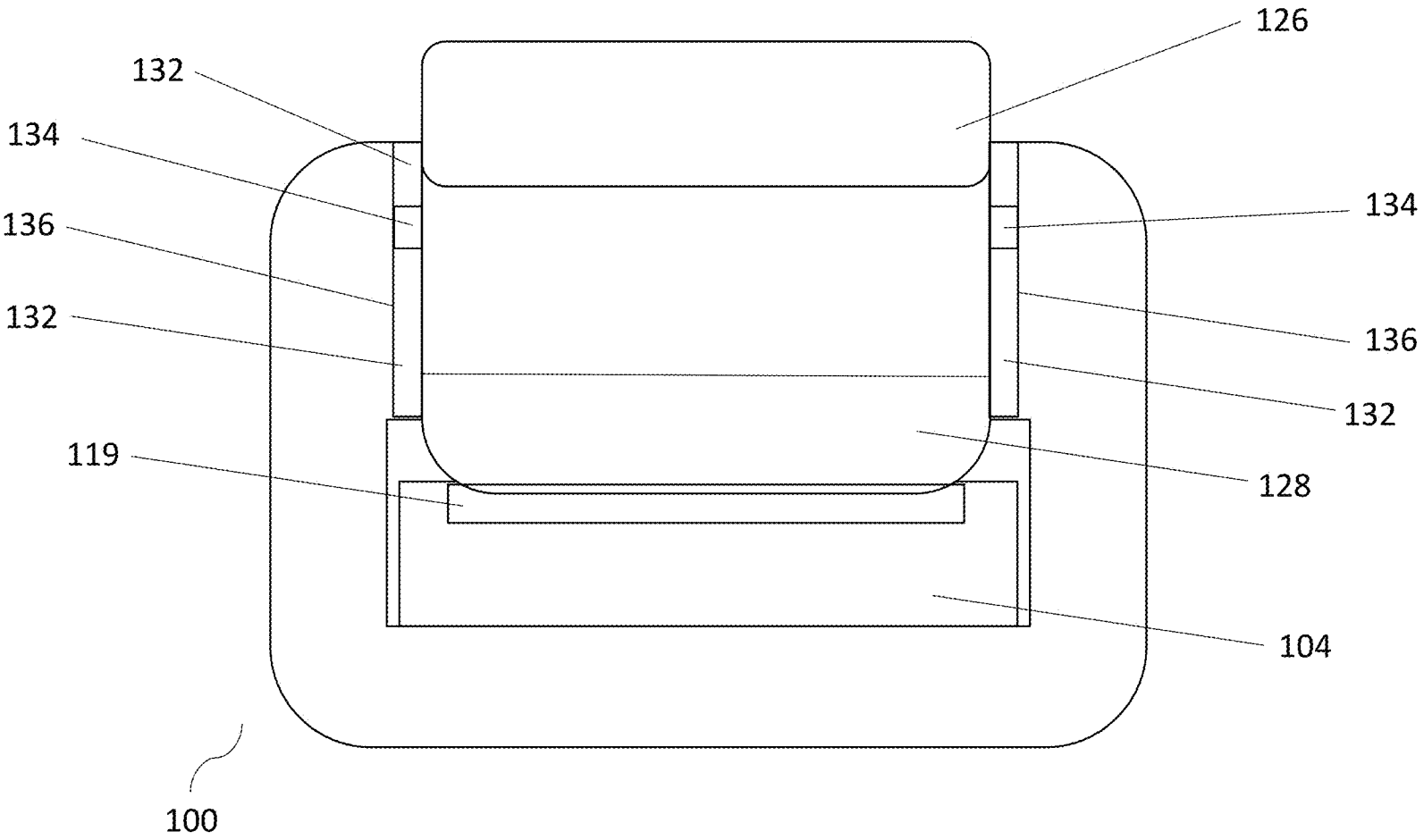
FIG. 20 is a left-side cross-section view of an exemplary retaining box of an exemplary alternative size adjustment system.

As shown in FIGS. 19-20, the exemplary engaging mechanism 130 is in operative rotatably movable connection with the retainer box 106 through a pivot 134. In exemplary arrangements, the exemplary pivot 134 extends transversely across the engaging mechanism opening 132 between lateral walls 136 that bound the opening 132. The structure of the engaging mechanism 130 and the pivot 134 is operative to bias the engaging mechanism 130 toward an engaged, undeformed position, shown in FIG. 19. In alternative exemplary arrangements, the engaging mechanism 130 includes a spring in operative connection therewith that is operative to bias the mechanism 130 toward the engaged position. That is, the lever 126 is biased in an engaging direction indicated at arrow 140 opposed of the outer face 116 of the second piece 104, and the engaging projection 128 is biased toward engagement with the recesses or projections 119 on the second piece or a flexible strap piece 104. In the engaged position, the engaging projection 128 of the mechanism 130 extends in a trough of one of the plurality of recesses or projections 119. The engaged position of the mechanism 130 within a trough of one of the plurality of recesses or projections 119 is operative to resist movement of the second piece or flexible strap piece 104 relative to the first piece or body 102 in the first direction indicated at arrow 16 and the second direction indicated at arrow 18. Of course, this arrangement is exemplary, and in other arrangements, other structures and approaches may be used.

As best shown in FIG. 19, manual manipulation of the lever 126 by a user in the disengaging direction indicated at arrow 138 is operative to cause the engaging mechanism 130 to rotate about the pivot 134 such that the lever 126 moves closer to the outer face 116 of the second piece 104. Movement of the lever 126 toward the outer face 116 causes the inward apex or point of the engaging projection 128 to move out of engagement with and be disposed from a trough of one of the recesses 119. When projection 128 is moved out of a respective trough of one of the recesses 119, the engaging mechanism 130 is in a disengaged, deformed position. In the disengaged position, a user is enabled to manipulate the second piece 104 to cause piece 104 to move longitudinally in either the first direction or the second direction relative to the first piece 102. Movement of the second piece 104 relative to the first piece 102 in the first direction 16 causes the hat size to decrease, while movement of the second piece 104 relative to the first piece 102 in the second direction 118 causes the hat size to increase. As such, the exemplary system 100 permits the user to adjust the size of the hat to a desired, more personalized fit. Of course, this arrangement is merely exemplary, and other structures and approaches may be used.

When the user has moved the second piece 104 relative to the first piece 102 to the desired, personalized fit, the user is enabled to lock the exemplary alternative size adjustment system 100 in the desired, personalized fit by manually releasing the lever 126. Manual release of the lever 126 is operative to cause the lever 126 to move in the engaging direction indicated at arrow 140 (i.e., away from the outer face 116 of second piece 104) responsive to the biasing force of the engaging mechanism 130. Movement of the lever 126 in the engaging direction is operative to cause the engaging mechanism 130 to be returned to the engaged, undeformed position as shown in FIG. 19, in which the inward point of the engaging projection 128 extends in engagement with the trough of the nearest recesses or projections 119 to the user's desired fit. The re-engagement of the engaging projection 128 with a trough is operative to lock the exemplary system 100 in the engaged, undeformed position, thereby assuring the hat will maintain the user's desired fit until further manipulation of the mechanism 130 to the disengaged or deformed position. As can be appreciated, this arrangement is merely exemplary, and other approaches may be used.

Figure 21:
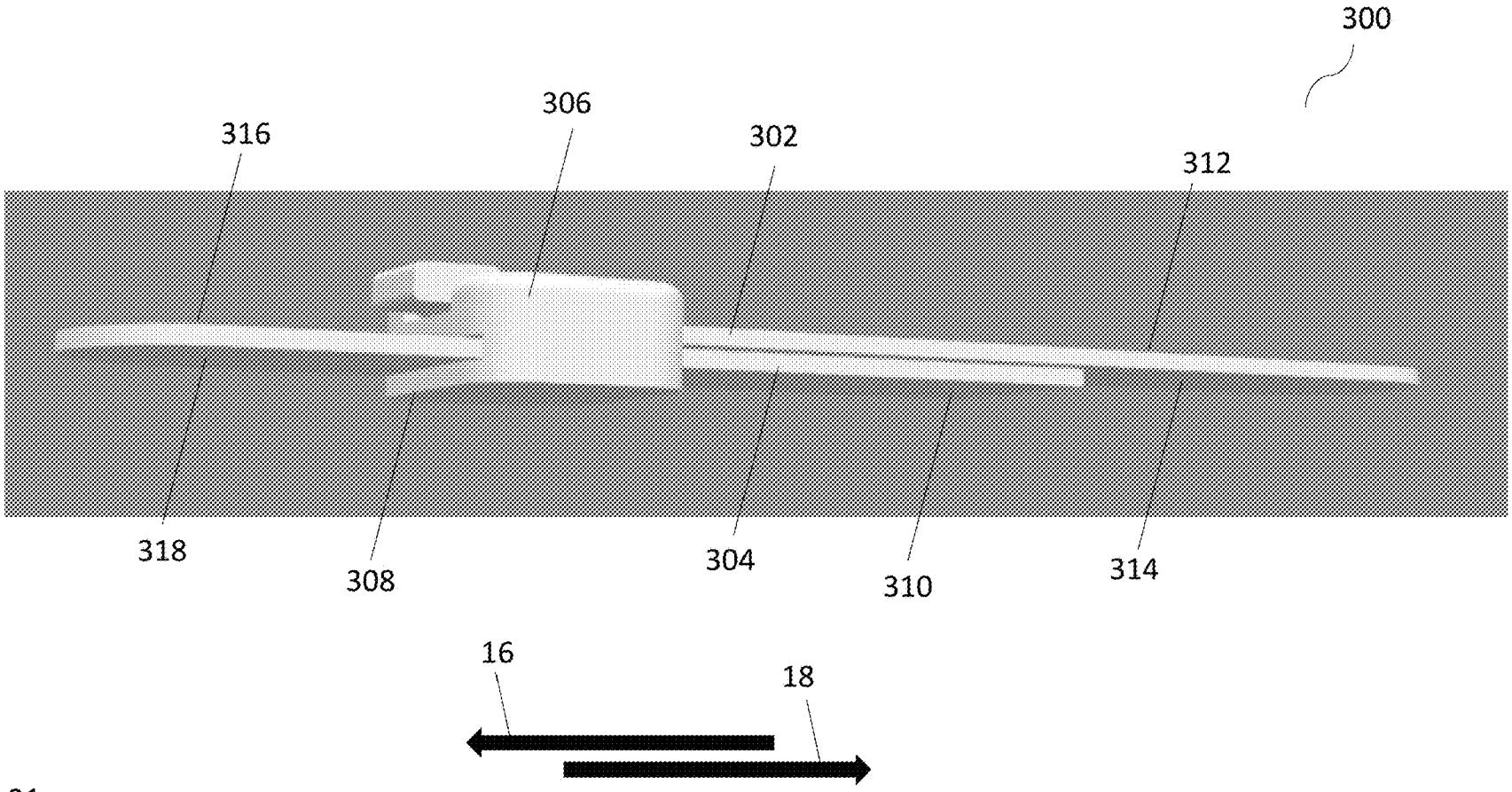
FIG. 21 is a front side perspective view of an alternative exemplary size adjustment system.

Now referring to FIG. 21, there is shown therein a further alternative exemplary size adjustment mechanism or system 300. The alternative exemplary size adjustment mechanism 300 operates in a similar manner to the other exemplary arrangements to move two portions of a hat or other article of clothing relative to each other and hold the portions in the selected relative positions, thereby creating a more personalized fit. However, the arrangement 300 will be described herein in operative connection with a hat. The exemplary size adjustment mechanism 300 includes a first piece or body 302, a second piece or flexible strap piece 304. The body includes a retainer box 306. The retainer box 306 is comprised of a flexible, deformable material and is in operative fixed connection with the first piece 302. Further, the retainer box 306 may be fully closed along its bottom wall, or may be open along its bottom wall, such as in shown in the arrangements FIGS. 22 and 23.

The exemplary first piece 302 includes an attachment portion 308 of the retainer box 306, and the exemplary second piece 304 includes an attachment portion 310. The exemplary attachment portions 308 and 310 are configured to be operatively attachable to or integrally formed with portions of an article of clothing or hat. The exemplary attachment portions 308 and 310 may be attached to the exemplary hat 24 through any of the attachment means or methods described in connection with the attachment portions of other exemplary arrangements discussed herein.

In some exemplary arrangements of the adjustment mechanism 300, the exemplary attachment portion 308 is operatively attached to or integrally formed with the outside surface of the hat 24 adjacent the first side 40 of the U-shaped opening 36. In alternative exemplary arrangements, the exemplary attachment portion 308 includes an attachment extension (not shown) that extends from the retainer box 306 in the first direction 16 through the vertical slot 43 on the first side 40 and is operatively connected or attached to at least one of the inside surface 28 or the band 30 within slot 43.

The exemplary attachment portion 310 is operatively attached to or integrally formed with the outside surface 26 of the hat 24 adjacent the second side 42 of the U-shaped opening 36. In alternative exemplary arrangements, the exemplary attachment portion 310 extends in the second direction 18 through the vertical slot 45 on the second side 42 and is operatively connected or attached to at least one of the inside surface 28 or the band 30 within slot 45. However, these arrangements are merely exemplary, and in other arrangements, other approaches may be used.

The exemplary first piece 302 includes a longitudinally extending outer face 312 and an opposing longitudinally extending inner face 314. Outer face 312 is disposed away from the second piece 304, and the inner face 314 is disposed toward the second piece 304. Similarly, the exemplary second piece 304 includes a longitudinally extending outer face 316 and an opposing longitudinally extending inner face 318. The exemplary inner face 314 of the first piece 302 and the outer face 316 of the second piece 304 extend in adjacent, facing relation. The exemplary second piece 304 includes a plurality of recesses or projections 319. The exemplary recess or projections 319 may be similar to the recesses or projections of the exemplary arrangements previously discussed herein, and include the vertical and beveled walls in which two respective walls converge together at their lower ends to form a trough, and a respective two converge at their upper ends to form a crest. However, projections and recesses of other shapes may be used as well.

In exemplary arrangements, the exemplary body or retainer box 306 comprises a generally rectangular or cube like structure. The exemplary retainer box 306 includes deck portion 320, a landing 322, and an opening 324. The opening 324 extends longitudinally, is rectangular in transverse cross-section, and is configured to receive the second piece 304 therethrough, which extends in the opening 324 below the deck portion 320 and in operative abutting engagement with the landing 322. The exemplary retainer box 306 further includes an engaging projection 328 that extends downward from the deck portion 320 into the opening 324 and toward the landing 322.

In exemplary arrangements, the engaging projection 328 is in operative connection with or integrally formed with the retainer box 306 adjacent the landing 322. The exemplary engaging projection 328 includes a connecting portion 330 and a recess engaging portion 332 which may alternatively be referred to herein as an apex or point. The connecting portion 330 operatively connects the engaging projection 328 to the deck portion 320 of the retainer box 306. The recess engaging portion 332 is configured to extend in and engage a trough of one of the plurality of recesses 319 of the second piece 304 when the second piece 304 extends in the opening 324 of the retainer box 306.

Figure 22:
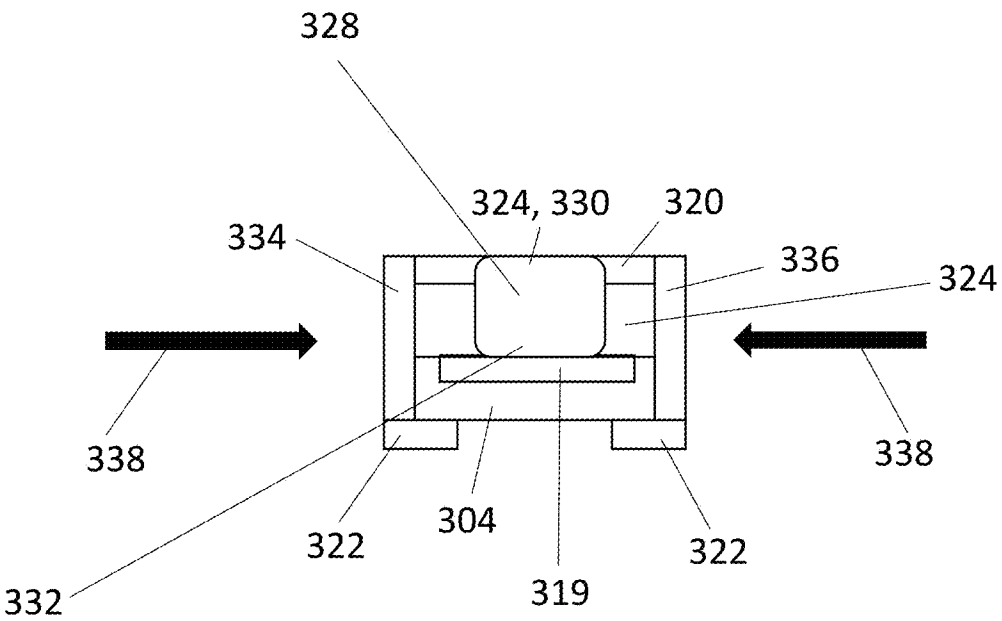
FIG. 22 is a left-side cross-section view of an alternative exemplary size adjustment system in an engaged position of an exemplary projection and exemplary recess.

In an engaged position of the exemplary adjustment mechanism 300 as shown in FIG. 22, the second piece 304 extends through the opening 324 and the recess engaging portion 332 of the engaging projection 328 extends in locking relation into a trough of one of the plurality of recesses 319. The locking relation of the engaging projection 328 and the recess or projections 319 is operative to resist longitudinal movement of the second piece 304 relative to the first piece 302 in either the first direction or the second direction.

In exemplary arrangements of the exemplary adjustment mechanism 300, as previously discussed, the exemplary body which comprises retainer box 306 is comprised of a flexible plastic or other deformable material. The exemplary flexible or deformable material is sufficiently deformable such that a user may utilize two fingers to squeeze sidewalls 334 and 336 together in a disengagement direction indicated at arrow 338. Squeezing of the sidewalls 334 and 336 in the disengagement direction is operative cause the deck portion 320 of the retainer box to become deformed to move or bridge in a direction opposed of the second piece 304 and landing 322, best shown in FIG. 23.

Figure 23:
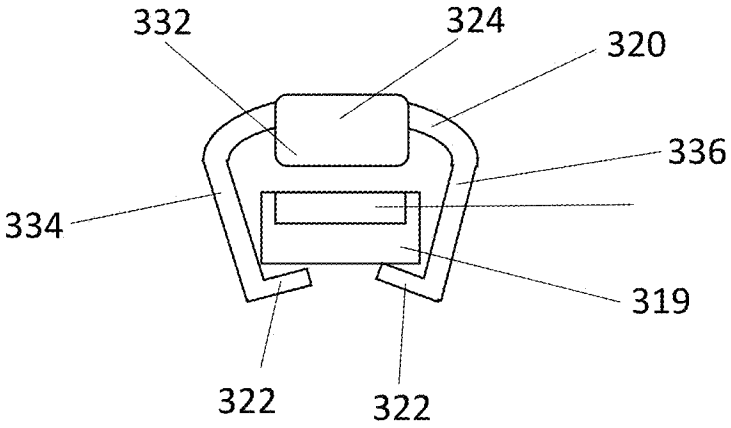
FIG. 23 is a left-side cross section of view of an alternative exemplary size adjustment system in a disengaged position of an exemplary projection and exemplary recess.

This deformation movement or bridging of the deck portion 320 is operative to draw the engaging projection 328 in a direction away from the second piece 304 and landing 322 such that the recess engaging portion 332 of the projection 328 is drawn out of and disposed away from the recess 319 in which it was previously extending. When the engaging projection is moved out of the recess 319, the exemplary mechanism 300 is in a disengaged or deformed position, as shown in FIG. 23. In the disengaged or deformed position, the exemplary second piece 304 is operatively adjustable and movable relative to the first piece 302 such that a user is enabled to manipulate the second piece 304 relative to the first piece 302 and to move the pieces relative to one another longitudinally in either the first direction or the second direction to obtain the user's desired, personalized fit of the hat.

The user, once the desired fit is obtained, is enabled to lock the size of the hat to the desired fit by releasing the squeezing pressure or ceasing deforming of the sidewalls 334 and 336 of the retainer box 306. Release of the squeezing pressure of the sidewalls 334 and 336 is operative to cause the engaging projection 328 to move in an engaging direction toward the second piece 304 and the landing 322. Movement of the projection 328 in the engaging direction is operative to cause the recess engaging portion 332 to extend into the nearest recess or projections 319 to the user's desired size and fit. This operation by the user returns the exemplary mechanism 300 to the engaged, undeformed position, as shown in FIG. 23. Of course, this arrangement is merely exemplary, and other approaches and configurations may be used.

Thus, the elements, features, and characteristics of the arrangements described herein achieve desirable results, eliminate difficulties encountered in the use of prior devices and systems, solve problems and attain one or more useful results described above.

In the foregoing description, certain terms have been used for brevity, clarity, and understanding. However, no unnecessary limitations are to be implied therefrom because such terms are used for descriptive purposes only and are intended to be broadly construed. Moreover, the descriptions and illustrations given herein are by way of examples and the useful features are not limited to the exact details shown and described.

Further, the descriptions which refer to left/right, top/bottom, up/down or similar terms indicating relative locations of items or components shall not be deemed limiting, and it will be understood that exemplary arrangements can be configured and used in numerous different orientations. In addition, all contact relationships disclosed herein may also include in alternative arrangements, relationships in which the respective structures are contacting, engaging, abutting, fixed, connecting, attached, or operative variations thereof.

Further, the descriptions which refer to first/second or similar indicating particular items or components may be used interchangeably.

Although the arrangements are discussed herein as individual and separate arrangements, it should be understood that the disclosure is not limited thereto. That is, features and/or relationships of one arrangement can be combined with features and/or relationships of another arrangement to obtain further arrangements, while still remaining within the scope of this disclosure.

Having described the features, discoveries, and principles of the exemplary arrangements, the manner in which they are constructed, operated, and utilized, and the advantages and useful results attained, the new and useful structures, devices, elements, arrangements, parts, combinations, systems, equipment, operations, methods, processes, and relationships are set forth in the appended claims.

What is claimed is:

1. A size adjustment system configured to be an integral part of an article of clothing, comprising:

a body, wherein the body
- is comprised of manually deformable material,
- includes a body opening that
  - extends longitudinally in the body, and
  - is rectangular in transverse cross-section,
- includes a movable projection that is integral with the body,
  - wherein in transverse cross-section the moveable projection includes an inwardly directed point,
- includes a generally planar longitudinally extending landing surface, wherein the landing surface
  - extends outside of the opening, and
  - in transverse cross-section is in aligned relation with one side of the opening,
- wherein the point is directed toward the landing surface, a flexible strap piece, wherein the flexible strap piece
- is elongated along the longitudinal direction,
- includes a pair of manually engageable outward extending projections, and
- in transverse cross-section
  - includes a pair of parallel opposed sides,
    - wherein at least one of the pair of sides includes a plurality of longitudinally spaced projections or recesses,
- wherein the flexible strap piece is configured to be longitudinally movable within the body opening,
- wherein in an undeformed position of the body
  - the point is in engagement with at least one of the longitudinally spaced projections or recesses, whereby the flexible strap piece is held longitudinally fixed in the opening, and
  - the flexible strap piece is movable responsive to manual force applied to the manually engageable outward extending projections, and
- wherein in a manually deformed position of the body the point is disengaged from the projections and recesses, whereby the flexible strap piece is longitudinally movable in the opening.

2. The size adjustment system according to claim 1, wherein the flexible strap piece is movable within the body opening in a first longitudinal direction and in an opposed second longitudinal direction, wherein movement of the flexible strap piece in the first longitudinal direction is operative to cause a decrease in size of the article of clothing, and wherein movement of the flexible strap piece in the second longitudinal direction is operative to cause an increase in the size of the article of clothing.

3. The size adjustment system according to claim 1, wherein the flexible strap piece is movable within the body opening in a first longitudinal direction and in an opposed second longitudinal direction, wherein movement of the flexible strap piece in the first longitudinal direction is operative to cause a decrease in a size of the article of clothing, and wherein movement of the flexible strap piece in the second longitudinal direction is operative to cause an increase in the size of the article of clothing, wherein in the undeformed position, the flexible strap piece is movable in the first longitudinal direction responsive to a manual force in the first longitudinal direction applied to the flexible strap piece.

4. The size adjustment system according to claim 1, wherein the body includes a flexible portion, wherein the flexible portion is integral with the body intermediate of the movable projection and the body, and is configured to be deformable such that the movable projection is enabled to be manually moved in a disengagement direction to cause disengagement of the movable projection and at least one of the plurality of longitudinally spaced projections or recesses.

5. The size adjustment system according to claim 1, wherein the body includes a flexible portion, wherein the flexible portion is integral with the body intermediate of the movable projection and the body, is configured to be deformable such that the movable projection is enabled to be manually moved in a disengagement direction to cause disengagement of the movable projection and at least one of the plurality of longitudinally spaced projections or recesses, and in the undeformed position, is configured to bias the movable projection toward the landing surface such that the point extends in engagement with at least one of the plurality of projections or recesses.

6. The size adjustment system according to claim 1, wherein the body includes a generally planar longitudinally extending outer face, wherein the outer face includes manually detectable indicia, wherein the manually detectable indicia is at least one of raised or lowered relative to the generally planar extending outer face, and is in aligned relation with the movable projection, whereby a user is enabled to tactilely locate the moveable projection.

7. The size adjustment system according to claim 1, wherein the article of clothing comprises a hat, wherein the hat includes a U-shaped opening, wherein the body is integrally formed with a first side of the U-shaped opening, wherein the flexible strap piece is integrally formed with the second side of the U-shaped opening, and wherein the body and the flexible strap piece extend longitudinally toward the other from their respective opposed sides of the U-shaped opening.

8. The size adjustment system according to claim 1, wherein each of the plurality of longitudinally spaced projections and recesses is disposed from an immediately adjacent projection or recess a distance, wherein the distance is within a range of 0.1 cm to 1.0 cm.

9. The size adjustment system according to claim 1, wherein the body includes a floating strap extension, wherein the floating strap extension is integrally formed with the body, is disposed on the body opposite of the moveable projection, and extends in the longitudinal direction in overlapping relation of the flexible strap piece.

10. The size adjustment system according to claim 1, wherein the body includes a floating strap extension, wherein the floating strap extension is integrally formed with the body, is disposed on the body opposite of the moveable projection, and extends in the longitudinal direction in overlapping relation of the flexible strap piece, a floating strap extension retainer, wherein the floating strap extension retainer is in operative connection with at least one of the body and the flexible strap piece, wherein the floating strap extension retainer is operative to maintain the floating strap extension in close overlaying proximity to the flexible strap piece.

11. The size adjustment system according to claim 1, wherein the body includes a floating strap extension, wherein the floating strap extension is integrally formed with the body, is disposed on the body opposite of the moveable projection, and extends in the longitudinal direction in overlapping relation of the flexible strap piece, further comprising:

a floating strap extension retainer, wherein the floating strap extension retainer is in operative connection with at least one of the body and the flexible strap piece, and wherein the floating strap extension retainer is operative to maintain the floating strap extension in close overlaying proximity to the flexible strap piece, wherein the floating strap extension retainer comprises at least one of a pair of magnets, wherein the body includes one of the pair of magnets and the flexible strap piece includes the other of the pair of magnets, and a retaining loop, wherein the retaining loop extends from one of the body and the flexible strap piece toward the other of the body and the flexible strap piece, and is configured to receive the other of the body and the flexible strap piece therethrough.

12. A size adjustment system configured to be an integral part of an article of clothing, comprising:

a body, wherein the body is comprised of manually deformable material, includes a body opening that extends longitudinally in the body, and is rectangular in transverse cross-section, includes a movable projection that is integral with the body, wherein in transverse cross-section the moveable projection includes a point, includes a generally planar longitudinally extending landing surface, wherein the landing surface extends outside of the opening, and in transverse cross-section is in aligned relation with one side of the opening, includes at least one first magnet, a flexible strap piece, wherein the flexible strap piece includes at least one second magnet, wherein the at least one second magnet is configured to be attracted to the at least one first magnet, is elongated along the longitudinal direction, and in transverse cross-section, includes a pair of parallel opposed sides, wherein at least one of the pair of sides includes a plurality of longitudinally spaced projections or recesses, wherein the flexible strap piece is configured to be longitudinally movable within the body opening, wherein in an undeformed position of the body the at least one first magnet and the at least one second magnet are in movably adjacent attracted relation, the point is in engagement with at least one of the longitudinally spaced projections or recesses,and the flexible strap piece is longitudinally moveable relative to the body in a first longitudinal direction but not in a second longitudinal direction opposed of the first longitudinal direction, responsive to manual force applied to the flexible strap piece, wherein in a manually deformed position of the body the point is disengaged from the projections and recesses, wherein the flexible strap piece is longitudinally movable in both the first longitudinal direction and the second longitudinal direction in the opening.

13. The size adjustment system according to claim 12, wherein movement of the flexible strap piece in the first longitudinal direction is operative to cause a decrease in a size of the article of clothing, and wherein movement of the flexible strap piece in the second longitudinal direction is operative to cause an increase in the size of the article of clothing.

14. The size adjustment system according to claim 12, wherein the flexible strap piece includes a pair of manually engageable outward extending projections, wherein in the undeformed position, the flexible strap piece is movable responsive to a manual force applied to the manually engageable outward extending projections.

15. The size adjustment system according to claim 12, wherein the body includes a floating strap extension, wherein the floating strap extension is integrally formed with the body, is disposed on the body opposite of the moveable projection, and extends in the longitudinal direction in overlapping relation of the flexible strap piece.

16. The size adjustment system according to claim 12, wherein the body includes a floating strap extension, wherein the floating strap extension is integrally formed with the body, is disposed on the body opposite of the moveable projection, and extends in the longitudinal direction in overlapping relation of the flexible strap piece, wherein the at least one first magnet and at least one second magnet are operative to maintain the floating strap extension in close overlaying proximity to the flexible strap piece.

17. The size adjustment system according to claim 12, wherein the article of clothing comprises a hat, wherein the hat includes a U-shaped opening, wherein the body is integrally formed with a first side of the U-shaped opening, wherein the flexible strap piece is integrally formed with the second side of the U-shaped opening, and wherein the body and the flexible strap piece extend longitudinally toward the other from their respective sides of the U-shaped opening.

18. A size adjustment system configured to be an integral part of an article of clothing, comprising:

a body, wherein the body is comprised of manually deformable material, wherein the body includes an opening that extends longitudinally in the body and is rectangular in transverse cross-section, a movable projection that is integral with the body, wherein in transverse cross-section the moveable projection includes a point, a generally planar longitudinally extending landing surface, wherein the landing surface extends outside of the opening, and in transverse cross-section is in aligned relation with one side of the opening, a floating strap extension, where the floating strap extension is integrally formed with the body, is disposed on the body opposite of the movable projection, and extends in the longitudinal direction, a flexible strap piece, wherein the flexible strap piece extends in overlapping relation with the floating strap extension, is elongated along the longitudinal direction, and in transverse cross-section, includes a pair of parallel opposed sides, wherein at least one of the pair of sides includes a plurality of longitudinally spaced projections or recesses, is configured to be longitudinally movable within the body opening, a floating strap extension retainer, wherein the floating strap extension retainer is in operative connection with at least one of the body and the flexible strap piece, and is operative to maintain the floating strap extension in close overlaying proximity to the flexible strap piece, wherein in an undeformed position of the body the point is in engagement with at least one of the longitudinally spaced projections or recesses, whereby the flexible strap piece is held longitudinally fixed in the opening, and wherein in a manually deformed position of the body the point is disengaged from the projections and recesses, whereby the flexible strap piece is longitudinally movable in the opening.

* * * * *